US010316263B2

(12) United States Patent
Rubin-Pitel et al.

(10) Patent No.: US 10,316,263 B2
(45) Date of Patent: Jun. 11, 2019

(54) FUEL COMPONENTS FROM HYDROPROCESSED DEASPHALTED OILS

(71) Applicant: ExxonMobil Research and Engineering Company, Annandale, NJ (US)

(72) Inventors: Sheryl B. Rubin-Pitel, Newtown, PA (US); Kenneth C. H. Kar, Philadelphia, PA (US); Kendall S. Fruchey, Easton, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 196 days.

(21) Appl. No.: 15/634,367

(22) Filed: Jun. 27, 2017

(65) Prior Publication Data

US 2018/0371343 A1 Dec. 27, 2018

(51) Int. Cl.

| | |
|---|---|
| ***C10L 1/04*** | (2006.01) |
| ***C10L 10/16*** | (2006.01) |
| ***C10L 10/08*** | (2006.01) |

(52) U.S. Cl.

CPC ..... *C10L 1/04* (2013.01); *C10L 10/08* (2013.01); *C10L 10/16* (2013.01); *C10L 2200/0438* (2013.01); *C10L 2230/20* (2013.01); *C10L 2290/24* (2013.01)

(58) Field of Classification Search

CPC .. C10L 1/04; C10L 10/16; C10L 10/08; C10L 2200/0438; C10L 2290/24; C10L 2230/20

See application file for complete search history.

(56) References Cited

U.S. PATENT DOCUMENTS

| | | | | |
|---|---|---|---|---|
| 3,414,506 | A | 12/1968 | Van Lookern | |
| 6,241,874 | B1 | 6/2001 | Wallace et al. | |
| 7,776,206 | B2 | 8/2010 | Miller et al. | |
| 7,914,665 | B2 * | 3/2011 | Zhang | C10G 67/04 208/108 |
| 8,114,678 | B2 | 2/2012 | Chawla et al. | |
| 8,361,309 | B2 | 1/2013 | Lopez et al. | |

(Continued)

FOREIGN PATENT DOCUMENTS

| | | | |
|---|---|---|---|
| JP | 3999911 | B2 | 10/2007 |
| JP | 4152127 | B2 | 9/2008 |

(Continued)

OTHER PUBLICATIONS

The International Search Report and Written Opinion of PCT/US2017/039467 dated Jan. 23, 2018.

(Continued)

*Primary Examiner* — Pamela H Weiss

(74) *Attorney, Agent, or Firm* — Kristina Okafor

(57) ABSTRACT

Fuels and/or fuel blending components can be formed from hydroprocessing of high lift deasphalted oil. The high lift deasphalting can correspond to solvent deasphalting to produce a yield of deasphalted oil of at least 50 wt %, or at least 65 wt %, or at least 75 wt %. The resulting fuels and/or fuel blending components formed by hydroprocessing of the deasphalted oil can have unexpectedly high naphthene content and/or density. Additionally or alternately, the resulting fuels and/or fuel blending components can have a clear and bright appearance.

25 Claims, 3 Drawing Sheets

(56) References Cited

U.S. PATENT DOCUMENTS

| | | | | |
|---|---|---|---|---|
| 8,987,537 | B1 * | 3/2015 | Droubi | C10L 1/04 585/14 |
| 9,005,380 | B2 | 4/2015 | Mathur | |
| 9,035,113 | B2 | 5/2015 | Lopez et al. | |
| 9,057,035 | B1 * | 6/2015 | Kraus | C10L 1/04 |
| 9,487,718 | B2 * | 11/2016 | Kraus | C10L 1/04 |
| 9,499,758 | B2 * | 11/2016 | Droubi | C10L 1/04 |
| 9,605,218 | B2 * | 3/2017 | Smiley | C10G 45/16 |
| 9,719,034 | B2 * | 8/2017 | Shih | C10G 69/02 |
| 9,771,524 | B2 * | 9/2017 | Xu | C10G 31/10 |
| 9,803,152 | B2 * | 10/2017 | Kar | C10L 1/08 |
| 10,047,299 | B2 * | 8/2018 | Rubin-Pitel | C10G 11/18 |
| 2007/0114377 | A1 | 5/2007 | Qian et al. | |
| 2009/0313890 | A1 | 12/2009 | Lopez et al. | |
| 2009/0313891 | A1 | 12/2009 | Varedeny et al. | |
| 2011/0139676 | A1 * | 6/2011 | McGehee | C10L 1/04 208/15 |
| 2012/0246999 | A1 * | 10/2012 | Stern | C10G 45/02 44/300 |
| 2013/0340323 | A1 * | 12/2013 | Stern | C10G 45/02 44/300 |
| 2015/0240174 | A1 * | 8/2015 | Kraus | C10L 1/04 585/13 |
| 2015/0337225 | A1 * | 11/2015 | Droubi | C10L 1/04 585/13 |
| 2015/0337226 | A1 * | 11/2015 | Droubi | C10L 1/04 585/13 |
| 2017/0002273 | A1 * | 1/2017 | Rubin-Pitel | C10G 11/18 |
| 2017/0009163 | A1 * | 1/2017 | Kraus | C10L 1/04 |
| 2017/0058223 | A1 * | 3/2017 | Droubi | C10L 1/04 |
| 2017/0183571 | A1 * | 6/2017 | Rubin-Pitel | C10G 25/003 |
| 2017/0183575 | A1 * | 6/2017 | Rubin-Pitel | C10G 25/003 |

FOREIGN PATENT DOCUMENTS

| | | | | |
|---|---|---|---|---|
| JP | 4268373 | B2 | 5/2009 | |
| JP | 4567947 | B2 | 10/2010 | |
| JP | 4567948 | B2 | 10/2010 | |
| JP | 4575646 | B2 | 11/2010 | |
| JP | 4593376 | B2 | 12/2010 | |
| JP | 4620381 | B2 | 1/2011 | |
| JP | 4994327 | B2 | 8/2012 | |
| JP | 5052876 | B2 | 10/2012 | |
| JP | 5128631 | B2 | 1/2013 | |
| JP | 5128633 | B2 | 1/2013 | |
| JP | 5205639 | B2 | 6/2013 | |
| JP | 5205640 | B2 | 6/2013 | |
| JP | 5205641 | B2 | 6/2013 | |
| JP | 5312646 | B2 | 10/2013 | |
| JP | 5328973 | B2 | 10/2013 | |
| JP | 5361499 | B2 | 12/2013 | |
| JP | 5520114 | B2 | 6/2014 | |
| JP | 5520115 | B2 | 6/2014 | |
| JP | 2015113405 | A | 6/2015 | |
| JP | 2016008263 | A1 | 1/2016 | |
| KR | 101566581 | B1 | 11/2015 | |
| WO | WO-2015178941 | A1 * | 11/2015 | C10L 1/04 |

OTHER PUBLICATIONS

Environment Canada et al., "Marine Diesel Fuel Oil", Nov. 20, 2013 Retrieved from the internet:https://web.archive.org/web/20131120121619if_/http://www.etc-cte.ec.gc.ca/databases/oilproperties/pdf/WEB_Marine_Diesel_Fuel_Oil.pdf.

* cited by examiner

FUEL COMPONENTS FROM HYDROPROCESSED DEASPHALTED OILS

FIELD

Systems, methods and compositions are provided related to production of fuels and/or fuel blending components from deasphalted oils produced by deasphalting of resid fractions.

BACKGROUND

Lubricant base stocks are one of the higher value products that can be generated from a crude oil or crude oil fraction. The ability to generate lubricant base stocks of a desired quality is often constrained by the availability of a suitable feedstock. For example, most conventional processes for lubricant base stock production involve starting with a crude fraction that has not been previously processed under severe conditions, such as a virgin gas oil fraction from a crude with moderate to low levels of initial sulfur content.

In some situations, a deasphalted oil formed by propane deasphalting of a vacuum resid can be used for additional lubricant base stock production. Deasphalted oils can potentially be suitable for production of heavier base stocks, such as bright stocks. However, the severity of propane deasphalting required in order to make a suitable feed for lubricant base stock production typically results in a yield of only about 30 wt % deasphalted oil relative to the vacuum resid feed.

U.S. Pat. No. 3,414,506 describes methods for making lubricating oils by hydrotreating pentane-alcohol-deasphalted short residue. The methods include performing deasphalting on a vacuum resid fraction with a deasphalting solvent comprising a mixture of an alkane, such as pentane, and one or more short chain alcohols, such as methanol and isopropyl alcohol. The deasphalted oil is then hydrotreated, followed by solvent extraction to perform sufficient VI uplift to form lubricating oils.

U.S. Pat. No. 7,776,206 describes methods for catalytically processing resides and/or deasphalted oils to form bright stock. A resid-derived stream, such as a deasphalted oil, is hydroprocessed to reduce the sulfur content to less than 1 wt % and reduce the nitrogen content to less than 0.5 wt %. The hydroprocessed stream is then fractionated to form a heavier fraction and a lighter fraction at a cut point between 1150° F.-1300° F. (620° C.-705° C.). The lighter fraction is then catalytically processed in various manners to form a bright stock.

U.S. Pat. No. 6,241,874 describes a system and method for integration of solvent deasphalting and gasification. The integration is based on using steam generated during the gasification as the heat source for recovering the deasphalting solvent from the deasphalted oil product.

SUMMARY

In various aspects, fuels and/or fuel blending components can be formed from hydroprocessing of high lift deasphalted oil. The high lift deasphalting can correspond to solvent deasphalting to produce a yield of deasphalted oil of at least 50 wt %, or at least 65 wt %, or at least 75 wt %. The resulting fuels and/or fuel blending components formed by hydroprocessing of the deasphalted oil can have unexpectedly high naphthene content and/or density. Additionally or alternately, the resulting fuels and/or fuel blending components can have a clear and bright appearance.

DETAILED DESCRIPTION

Figure 1:
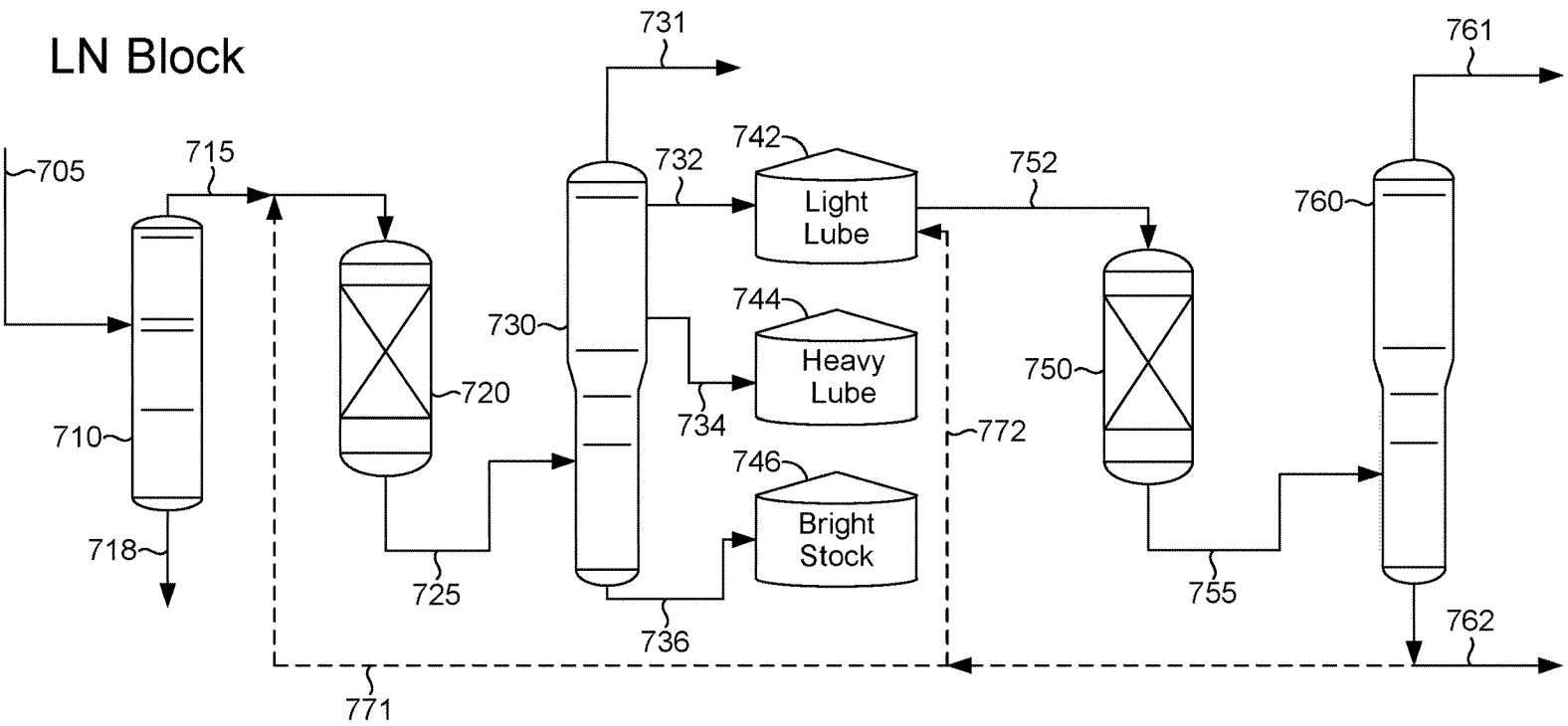
FIG. 1 schematically shows an example of a configuration for block catalytic processing of deasphalted oil to form lubricant base stocks.

All numerical values within the detailed description and the claims herein are modified by "about" or "approximately" the indicated value, and take into account experimental error and variations that would be expected by a person having ordinary skill in the art.

In various aspects, fuels and/or fuel blending components can be formed from hydroprocessing of high lift deasphalted oil. The high lift deasphalting can correspond to solvent deasphalting to produce a yield of deasphalted oil of at least 50 wt %, or at least 65 wt %, or at least 75 wt %. The feed used for the solvent deasphalting can be a resid-containing feed, such as a feed with a T10 distillation point of at least 400° C., or at least 450° C., or at least 510° C., such as up to 570° C. or more. The resulting fuels and/or fuel blending components formed by hydroprocessing of the deasphalted oil can have unexpectedly high naphthene content and/or density. Additionally or alternately, deasphalted oil generated from high lift deasphalting represents a disadvantaged feed that can be converted into a fuel and/or fuel blending components with unexpected compositions. Additionally or alternately, the resulting fuels and/or fuel blending components can have unexpectedly beneficial cold flow properties, such as cloud point, pour point, and/or freeze point.

In some aspects, the fuels and/or fuel blending components derived from hydroprocessing of high lift deasphalted oil can allow for incorporation of hydroprocessed deasphalted oil components into a marine gas oil or marine fuel oil that has an unusually clear and bright visual appearance. For many types of marine gas oil or marine fuel oil, any high viscosity components that are incorporated into the fuel can correspond to components with a dark color and/or a hazy or murky appearance. In particular, vacuum gas oil boiling range (or heavier) fractions incorporated into a marine gas oil or fuel oil can tend to have a black and/or opaque color. By contrast, the hydroprocessed deasphalted oil fractions and/or fuels containing one or more hydroprocessed deasphalted oil fractions as described herein can generally have a clear and bright appearance upon visual inspection. Such fractions can have an ASTM Color according to ASTM D1500 of 3.0 or less, or 2.0 or less, or 1.0 or less, or 0.5 or less.

Additionally or alternately, hydroprocessed deasphalted oil fractions and/or fuels including one or more hydroprocessed deasphalted oil fractions as a component can be evaluated visually as passing or failing with regard to the presence of water droplets and/or particles and/or satisfying a "clear and bright" standard using a procedure similar to ASTM D4176. While ASTM D4176 is intended for use with fuels having an end boiling point of 400° C. or less, the methods in both Procedure 1 and Procedure 2 from ASTM D4176 can be used for evaluation of the hydroprocessed deasphalted oil fractions described herein. Additionally, Procedure 1 and/or Procedure 2 from ASTM D4176 can provide a standard for determining that a fuel blend incorporating a hydroprocessed deasphalted oil fraction satisfies a "clear and bright" standard.

In this discussion, unless otherwise specified, references to a fuel blend satisfying a "clear and bright" standard are defined to correspond to "clear and bright" as determined according to ASTM D4176 Procedure 1. When specified, Procedure 2 can alternatively be used to determine "clear and bright" based on a sample having a haze rating of 1 under the test in Procedure 2. It is noted that the fuels typically tested according to ASTM D4176 will typically have cloud points that are well below ambient temperature. Although some of the hydroprocessed deasphalted oil fractions described herein may have an end boiling point greater than 400° C., the hydroprocessed deasphalted oil fractions and/or fuels containing such a fraction that are described herein as satisfying a "clear and bright" standard can also have a sufficiently low cloud point for evaluation under Procedure 1 or 2 of ASTM D4176.

Conventionally, solvent deasphalting is typically performed to generate deasphalted oil yields of 40 wt % or less, resulting in production of 60 wt % or more of deasphalter rock. In various aspects, a deasphalting process can be performed to generate a higher yield of deasphalted oil. Under conventional standards, increasing the yield of deasphalted oil can result in a lower value for the deasphalted oil, causing it to be less suitable for production of fuels and/or lubricant basestocks. Additionally, by increasing the yield of deasphalted oil, the corresponding deasphalter rock can have a lower percentage of desirable molecules according to conventional standards. Based on these conventional views, performing solvent deasphalting to generate a still less favorable type of deasphalter rock while also generating a lower value deasphalted oil is typically avoided.

In contrast to the conventional view, it has been discovered that high lift deasphalting can be used to make fuels and/or lubricant basestocks with desirable properties by hydroprocessing of the high lift deasphalted oil. This is in contrast to methods for making conventional Group I lubricants, where an aromatic extraction process (using a typical aromatic extraction solvent, such as phenol, furfural, or N-methylpyrrolidone) is used to reduce the aromatic content of the feed. Hydroprocessing to form fuels and/or lubricants can represent one potential application for high lift deasphalting. In such applications where deasphalting is performed to generate greater than 50 wt % deasphalted oil, the resulting fuels boiling range fractions generated during hydroprocessing can have unexpectedly high naphthene contents and/or unexpectedly high densities. Additionally or alternately, the resulting fuels boiling range fractions can have beneficial combustion properties, such as unexpectedly low calculated carbon aromaticity index (CCAI) and/or unexpectedly high cetane and/or beneficial cold flow properties. This can potentially provide advantages when blending the fuel boiling range fractions with other fuel components and/or fuel blending components to form a desired fuel, such as a distillate fuel or a fuel oil.

After forming a high lift deasphalted oil, the deasphalted oil can be hydroprocessed for various reasons. In some aspects, one or more stages of hydroprocessing can be used to reduce the sulfur content of the deasphalted oil and/or to saturate at least a portion of the aromatics in the deasphalted oil. In other aspects, a plurality of stages can be used to potentially form lubricant basestocks from deasphalted oil. During such lubricant basestock production, conversion of the feed can result in production of various naphtha boiling range fractions and/or distillate boiling range fractions. In still other aspects, it may be desirable to have a flexible process, where in some instances a higher boiling fraction (possibly bottoms fraction) is used for fuels production instead of for lubricant basestock production.

For example, after processing deasphalted by demetallization/hydrotreating/hydrocracking in one or more initial stages, the initial stage effluent can be fractionated to produce distilled fractions and a bottoms fraction. The distilled fractions may be cut at various fractionation points to produce: a) a naphtha stream potentially suitable for blending in gasoline; b) a jet/kerosene range distillate stream suitable for blending in jet fuel (kerosene for aviation use), non-aviation kerosene, diesel fuel, gasoils, marine gasoils, or heating oil or as a flux or marine fuel oil; c) a diesel range distillate stream suitable for blending into diesel fuel, gasoils, marine gasoils, and/or heating oil or as a flux or marine fuel oil, or it may be suitable for use as a marine gasoil meeting the ISO 8217 DMB grade; d) or the jet and diesel streams may be collected as a single fraction to make a wide-cut distillate stream (jet+diesel) suitable for blending in diesel fuel, gasoils, marine gasoils, or heating oil or as a flux or marine fuel oil, or it may be suitable for use as a marine gasoil meeting the ISO 8217 DMA grade.

The bottoms fraction from the initial stage(s) can be used as feed to the second stage(s) or optionally could be used as a blend component for residual marine fuel. Due to their low sulfur level the bottoms streams would be a suitable blend component for residual marine fuel for use in Emissions Control Areas, where <0.1 wt % sulfur is mandated, or a blend stock for blending <0.5 wt % sulfur marine fuel.

For any portion of the initial stage(s) bottoms that is exposed to further processing in one or more additional stages the additional stage effluent can be fractionated to produce distilled fractions and bottoms. The distilled fractions may be cut at various fractionation points to produce: e) a naphtha stream potentially suitable for blending in gasoline; f) a jet/kerosene range distillate stream suitable for blending in jet fuel (kerosene for aviation use), non-aviation kerosene, diesel fuel, gasoils, marine gasoils, or heating oil or as a flux or marine fuel oil; g) a distillate stream suitable for blending into diesel fuel, gasoils, marine gasoils, and/or heating oil or as a flux or marine fuel oil, or it may be suitable for use as a marine gasoil meeting the ISO 8217 DMB grade; h) or the jet and diesel streams may be collected as a single fraction to make a wide-cut distillate stream (jet+diesel) suitable for blending in diesel fuel, gasoils, marine gasoils, and/or heating oil or as a flux or marine fuel oil, or it may be suitable for use as a marine gasoil meeting the ISO 8217 DMA grade; and/or i) a heavy distillate cut (12) which may be suitable for blending into diesel fuel, gasoils, marine gasoils, and/or heating oil or as a flux or residual marine fuel oil.

While the higher boiling fractions (including a bottoms fraction) from the additional processing stages can often be suitable for lubricant basestock or brightstock product, the higher boiling fractions could be used as a blend component for residual marine fuel meeting the ISO 8217 Table 2 requirements. Due to their low sulfur level the higher boiling fractions (including the bottoms fraction) would be a suitable blend component for residual marine fuel for use in Emissions Control Areas, where <0.1 wt % sulfur is mandated, or a blend stock for blending <0.5 wt % sulfur marine fuel which will be mandated for use in the open ocean post 2020 (by the International Maritime Organization) unless a marine vessel has an exhaust gas cleaning system onboard. Optionally, if a brightstock product is formed, an extract fraction from performing solvent extraction on the brightstock product could potentially also be utilized as a fuel oil blending component.

Various portions or fractions of a hydroprocessed deasphalted oil can potentially be suitable for incorporation into a marine gas oil or marine fuel oil. Suitable fractions can include, but are not limited to, fractions having a density at 15° C. of 0.81 g/cm$^3$ to 0.92 g/cm$^3$, or 0.81 g/cm$^3$ to 0.90 g/cm$^3$, or 0.83 g/cm$^3$ to 0.90 g/cm$^3$. This can allow for production of blended fuel products having a density at 15° C. of 0.81 g/cm$^3$ to 0.98 g/cm$^3$. Some heavier suitable blended fuel products can have a density at 15° C. of 0.84 g/cm$^3$ to 0.98 g/cm$^3$, or 0.84 g/cm$^3$ to 0.96 g/cm$^3$, or 0.84 g/cm$^3$ to 0.92 g/cm$^3$, or 0.84 g/cm$^3$ to 0.90 g/cm$^3$. Other blended fuel products can have a density at 15° C. of 0.81 g/cm$^3$ to 0.90 g/cm$^3$.

In various aspects, suitable hydroprocessed deasphalted oil fractions can have a T10 distillation point of 200° C. or more, or 250° C. or more, or 300° C. or more. Such hydroprocessed deasphalted oil fractions can be "clear and bright" according to Procedure 1 of ASTM D4176 and/or can have an ASTM Color (D1500) of 3.0 or less, or 2.0 or less, or 1.0 or less, or 0.5 or less.

As noted above, in some alternative aspects, "clear and bright" can correspond to a sample having a haze rating of 1 under Procedure 2 of ASTM D4176.

In some aspects, suitable hydroprocessed deasphalted oil fractions can have a kinematic viscosity at 100° C. of 3.5 cSt or more. For example, the kinematic viscosity at 100° C. can be 3.5 cSt to 50 cSt, or 8.0 cSt to 50 cSt, or 10 cSt to 50 cSt, or 15 cSt to 50 cSt, or 25 cSt to 50 cSt. In some aspects, suitable hydroprocessed deasphalted oil fractions can have a kinematic viscosity at 40° C. 3.0 cSt to 30 cSt. Additionally or alternately, a hydroprocessed deasphalted oil fraction can have a viscosity index of 80 or more, or 80 to 120. Additionally or alternately, a hydroprocessed deasphalted oil fraction can have a naphthenes content of 50 wt % or more, or 60 wt % or more, or 70 wt % or more, or 80 wt % or more. Additionally or alternately, a hydroprocessed deasphalted oil fraction can have a sulfur content of 300 wppm or less, or 100 wppm or less, or 50 wppm or less, or 10 wppm or less.

The amount of hydroprocessed deasphalted oil in a fuel blend can vary depending on the nature of the blended fuel product. In various aspects, the amount of hydroprocessed deasphalted oil can be 0.5 wt % to 80 wt %, or 3 wt % to 80 wt %, or 10 wt % to 80 wt %, or 25 wt % to 80 wt %, or 40 wt % to 80 wt %, or 50 wt % to 80 wt %, or 60 wt % to 80 wt %.

In various aspects, the resulting blended fuel products can be "clear and bright" according to Procedure 1 of ASTM D4176 and/or can have an ASTM Color (D1500) of 3.0 or less, or 1.0 or less, or 0.5 or less. Additionally or alternately, the resulting blended fuel products can have a calculated carbon aromaticity index of 850 or less, or 800 or less, or 780 or less, or 760 or less, such as down to 720 or possibly still lower. As noted above, in some alternative aspects, "clear and bright" can correspond to a sample having a haze rating of 1 under Procedure 2 of ASTM D4176.

In various aspects, the resulting blended fuel products can have a kinematic viscosity at 50° C. of 380 cSt or less (such as 3 cSt to 380 cSt). For example, the kinematic viscosity at 50° C. can be 380 cSt or less, or 180 cSt or less, or 80 cSt or less, or 30 cSt or less, or 10 cSt or less. Additionally or alternately, a resulting blended fuel product can have a sulfur content of 5000 wppm or less, or 1000 wppm or less, or 500 wppm or less, or 100 wppm or less.

Figure 2:
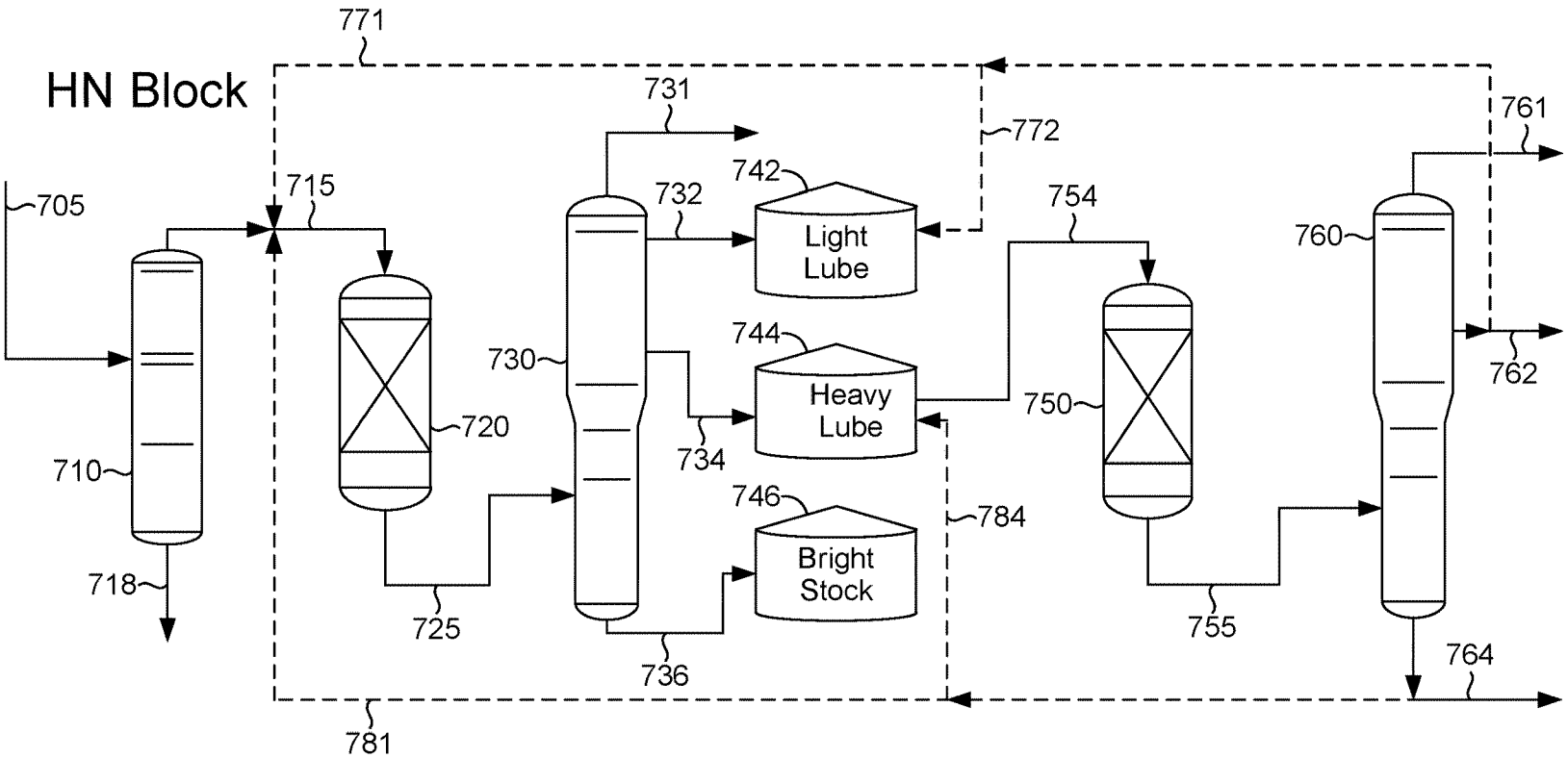
FIG. 2 schematically shows an example of a configuration for block catalytic processing of deasphalted oil to form lubricant base stocks.
Figure 3:
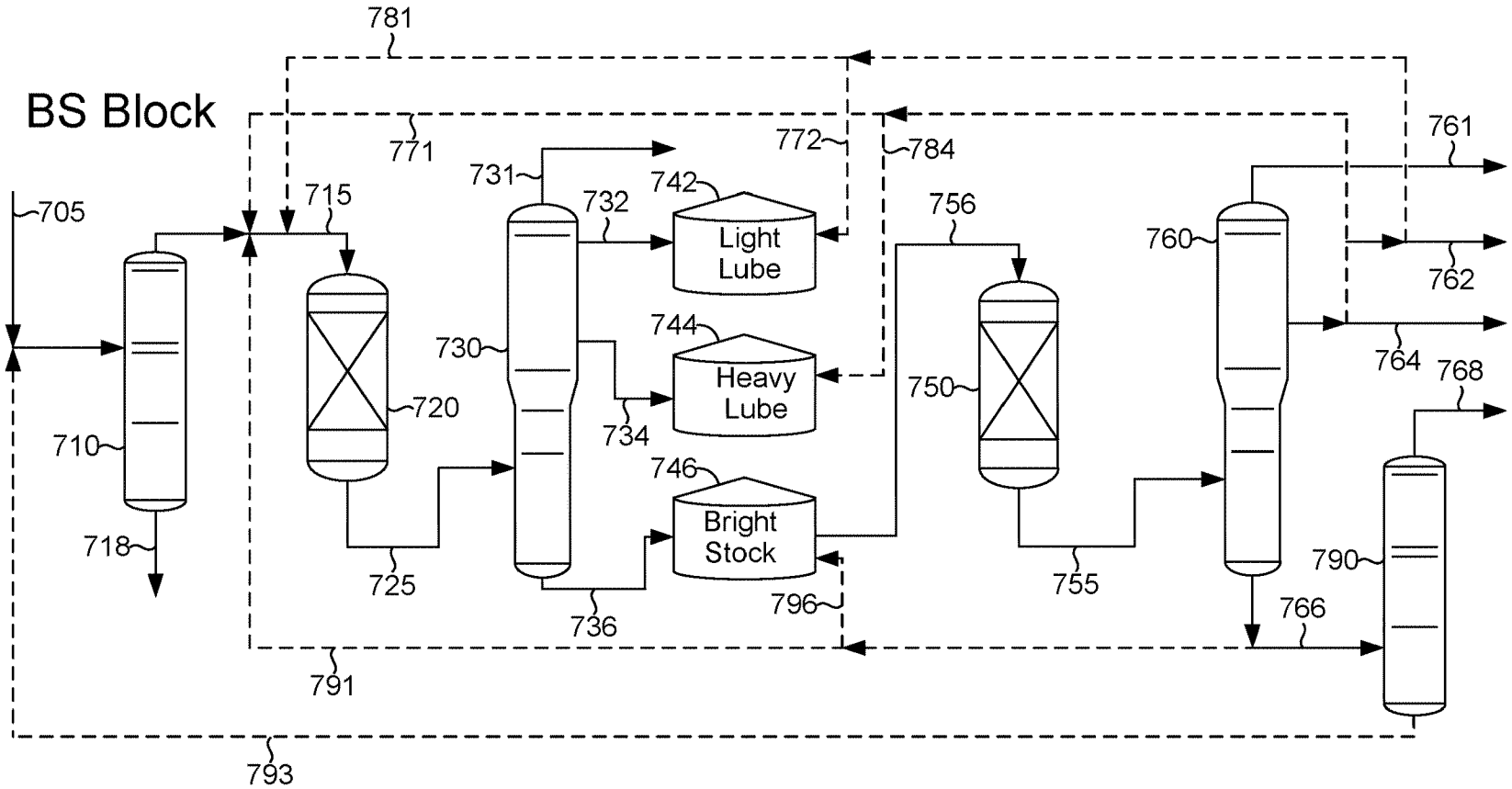
FIG. 3 schematically shows an example of a configuration for block catalytic processing of deasphalted oil to form lubricant base stocks.

FIGS. 1 to 3 show examples of a process configuration for hydroprocessing of a high lift deasphalted oil. In some aspects, the configurations in FIGS. 1 to 3 can be used for production of lubricant basestocks, such as brightstocks, from a deasphalted oil feed. In other aspects, at least a portion of the higher boiling (such as distillate or bottoms) fractions from the first processing stage(s) and/or the second processing stage(s) can be used for production of fuel oils and/or fuel oil blendstocks. Both the first stage(s) and second stage(s) can generate distillate fuel boiling range portions due to conversion of the deasphalted oil feed.

FIGS. 1 to 3 show examples of using blocked operation and/or partial product recycle during fuels/lubricant production based on a feed including deasphalted resid. In FIGS. 1 to 3, after initial sour stage processing, the hydroprocessed effluent is fractionated to form light neutral, heavy neutral, and brightstock portions. FIG. 1 shows an example of the process flow during processing to form light neutral base stock. FIG. 2 shows an example of the process flow during processing to form heavy neutral base stock. FIG. 3 shows an example of the process flow during processing to form brightstock.

In FIG. 1, a feed 705 is introduced into a deasphalter 710. The deasphalter 710 generates a deasphalted oil 715 and deasphalter rock or residue 718. The deasphalted oil 715 is then processed in a sour processing stage 720. Optionally, a portion 771 of recycled light neutral base product 762 can be combined with deasphalted oil 715. Sour processing stage 720 can include one or more of a deasphalting catalyst, a hydrotreating catalyst, a hydrocracking catalyst, and/or an aromatic saturation catalyst. The conditions in sour processing stage 720 can be selected to at least reduce the sulfur content of the hydroprocessed effluent 725 to 20 wppm or less. This can correspond to 15 wt % to 40 wt % conversion of the feed relative to 370° C. Optionally, the amount of conversion in the sour processing stage 720 can be any convenient higher amount so long as the combined conversion in sour processing stage 720 and sweet processing stage 750 is 90 wt % or less.

The hydroprocessed effluent 725 can then be passed into fractionation stage 730 for separation into a plurality of fractions. In the example shown in FIG. 1, the hydroprocessed effluent is separated into a light neutral portion 732, a heavy neutral portion 734, and a brightstock portion 736. To allow for blocked operation, the light neutral portion 732 can be sent to corresponding light neutral storage 742, the heavy neutral portion 734 can be sent to corresponding heavy neutral storage 744, and the brightstock portion 736 can be sent to corresponding brightstock storage 746. A lower boiling range fraction 731 corresponding to fuels and/or light ends can also be generated by fractionation stage 730. Optionally, fractionation stage can generate a plurality of lower boiling range fractions 731.

FIG. 1 shows an example of the processing system during a light neutral processing block. In FIG. 1, the feed 752 to sweet processing stage 750 corresponds to a feed derived from light neutral storage 742. The sweet processing stage 750 can include at least dewaxing catalyst, and optionally can further include one or more of hydrocracking catalyst and aromatics saturation catalyst. The dewaxed effluent 755 from sweet processing stage 750 can then be passed into a fractionator 760 to form light neutral base stock product 762. A lower boiling fraction 761 corresponding to fuels and/or light ends can also be separated out by fractionator 760. Optionally, a portion of light neutral base stock 762 can be recycled. The recycled portion of light neutral base stock 762 can be used as a recycled feed portion 771 and/or as a recycled portion 772 that is added to light neutral storage 742. Recycling a portion 771 for use as part of the feed can be beneficial for increasing the lifetime of the catalysts in sour processing stage 720. Recycling a portion 772 to light neutral storage 742 can be beneficial for increasing conversion and/or VI.

FIG. 2 shows the same processing configuration during processing of a heavy neutral block. In FIG. 2, the feed 754 to sweet processing stage 750 is derived from heavy neutral storage 744. The dewaxed effluent 755 from sweet processing stage 750 can be fractionated 760 to form lower boiling portion 761, heavy neutral base stock product 764, and light neutral base stock product 762. Because block operation to form a heavy neutral base stock results in production of both a light neutral product 762 and a heavy neutral product 764, various optional recycle streams can also be used. In the example shown in FIG. 2, optional recycle portions 771 and 772 can be used for recycle of the light neutral product 762. Additionally, optional recycle portions 781 and 784 can be used for recycle of the heavy neutral product 764. Recycle portions 781 and 784 can provide similar benefits to those for recycle portions 771 and/or 772.

FIG. 3 shows the same processing configuration during processing of a bright stock block. In FIG. 3, the feed 756 to sweet processing stage 750 is derived from bright stock storage 746. The dewaxed effluent 755 from sweet processing stage 750 can be fractionated 760 to form lower boiling portion 761, bottoms product 766, heavy neutral base stock product 764, and light neutral base stock product 762. Bottoms product 766 can then be extracted 790 to form a bright stock product 768. The aromatic extract 793 produced in extractor 790 can be recycled for use, for example, as part of the feed to deasphalter 710.

Because block operation to form a bright stock results in production of a bright stock product 768 as well as a light neutral product 762 and a heavy neutral product 764, various optional recycle streams can also be used. In the example shown in FIG. 3, optional recycle portions 771 and 772 can be used for recycle of the light neutral product 762, while optional recycle portions 781 and 784 can be used for recycle of the heavy neutral product 764. Additionally, optional recycle portions 791 and 796 can be used for recycle of the bottoms product 766. Recycle portions 791 and 796 can provide similar benefits to those for recycle portions 771, 772, 781, and/or 784.

The distillates from hydroprocessing of deasphalted oil can be characterized by a beneficial combination of properties: low sulfur, low aromatics, good cetane (generally ~40 cetane index and higher), but also higher density owing to a higher content of naphthenes. The jet could be used as a blendstock to lower smoke point in a kerosene/jet fuel with high smoke point, while maintaining density. In general the distillate streams could be used to simultaneously correct a blend to lower sulfur and lower aromatics while maintaining density and maintaining or improving cetane. Additionally, the above benefits can be provided in conjunction with improved cold flow properties. Other available streams that could be used to simultaneously lower sulfur and lower aromatics, such as a gas-to-liquids diesel or hydtrotreated vegetable oil, are composed of isoparaffin and paraffin and therefore would lead to a directional reduction in density and loss of volumetric energy content. The distillates can also be used to create a diesel product with high volumetric energy content while maintaining cetane. A high energy content fuel provides better fuel economy in a vehicle, all else equal. Traditionally the energy content of diesel fuel can be increased by adding aromatics, but at a cost of worsening the cetane quality. Ultimately cetane can limit the extent of aromatic blending. The distillates from hydroprocessed deasphalted oil can overcome this limitation because the trade off between energy content and cetane does not exist.

As one example, distillates formed by hydroprocessing of a deasphalted oil can include a first portion comprising a T5 distillation point of at least 190° C., or at least 200° C., and a T90 distillation point of 300° C. or less, or a T95 distillation point of 300° C. or less. In this type of example, the first portion can include 85 wt % to 98 wt % of saturates, or 85 wt % to 95 wt %, or 90 wt % to 98 wt %. A portion of the saturates can correspond to naphthenes. Relative to the weight of the first portion, the naphthene content can be at least 50 wt %, or at least 55 wt %, or at least 60 wt %, or at least 65 wt %, or at least 70 wt %, or at least 75 wt %, such as up to 80 wt % or more. The density of the first portion can be dependent on the naphthene content. A first portion with a lower naphthene content (such as 50 wt % to 65 wt %) can have a density of 0.84 g/cm$^3$ or less, or 0.83 g/cm$^3$ or less, such as down to 0.80 g/cm$^3$ or less, while a first portion with a higher naphthene content (such as 65 wt % to 80 wt %) can have a density of at least or 0.85 g/cm$^3$, or at least 0.86 g/cm$^3$, such as up to 0.90 g/cm$^3$ or more. The first portion can have a cetane index and/or derived cetane number of at least 40, or at least 44, or at least 46, or at least 50, or at least 60, depending on the aspect.

As another example, distillates formed by hydroprocessing of a deasphalted oil can include a first portion comprising a T5 distillation point of at least 270° C., or at least 290° C., or at least 300° C., and a T95 distillation point of 400° C. or less, or 380° C. or less. In this type of example, the first portion can have a density at 15° C. of at least 0.85 g/cm$^3$, or at least 0.86 g/cm$^3$, such as up to 0.90 g/cm$^3$ or more. In this type of example, the first portion can include at least 70 wt % saturates, or at least 90 wt %, or at least 95 wt %, or at least 98 wt %. A portion of the saturates can correspond to naphthenes. Relative to the weight of the first portion, the naphthene content can be at least 50 wt %, or at least 60 wt %, such as up to 80 wt % or more. The first portion can have a cetane index and/or derived cetane number of at least 40, or at least 44, or at least 46, or at least 50, or at least 60, depending on the aspect.

The bottoms streams from hydroprocessing of deasphalted oil can be characterized by a beneficial combination of properties: low sulfur, very good combustion quality as measured by CCAI (756 CCAI and lower), and lower density compared to typical marine fuels. The bottoms streams can have a low enough sulfur (<<0.1 wt %) that they are suitable for blending into ECA fuels. Typical refining process concentrates sulfur in bottoms material that is used to make marine fuels. Therefore there are very few potential blendstocks for making ECA fuels. The bottoms streams could be used to simultaneously correct a blend to lower sulfur, lower density, and higher CCAI. ECA fuels in the market e.g. marine gas oil (MGO) have too low kinematic viscosity for the fuel injection equipment to work properly due to ambient heat in fuel systems (designed to operate on residual fuel). To operate on MGO, some marine vessels operate a chiller to cool the MGO and maintain viscosity. Blending MGO into a heavier ECA to correct sulfur, density, and CCAI can lower the kinematic viscosity and result in the same challenge. The bottoms can provide flexibility when making ECA fuels, to correct sulfur, density and CCAI while maintaining sufficiently high kinematic viscosity. The sulfur level of the bottoms is so low that it may allow for some amount of relatively high sulfur material to be blended into an ECA fuel. However, the low BMCI of the bottoms indicates that its compatibility with typical, aromatic, asphaltene-containing, higher sulfur fuel oils may be limited.

As an example, a bottoms fraction formed by hydroprocessing of a deasphalted oil can comprise a T10 distillation point of at least 370° C., or at least 400° C., or at least 500° C., or at least 550° C., and a T90 distillation point of 700° C. or less. In this type of example, the bottoms can have a density at 70° C. of 0.86 g/cm$^3$ or less, or 0.85 g/cm$^3$ or less, such as down to 0.80 g/cm$^3$ or less. In this type of example, the bottoms can include at least 75 wt % saturates, or at least 80 wt %, or at least 90 wt %. A portion of the saturates can correspond to naphthenes. Relative to the weight of the bottoms, the naphthene content can be at least 50 wt %, or at least 60 wt %, such as up to 80 wt % or more. The bottoms can have a calculated carbon aromaticity index of 760 or less, or 740 or less and/or a Conradson carbon content of 1.5 wt % or less, or 1.0 wt % or less, or 0.5 wt % or less. The sulfur content can be 100 wppm or less, or 50 wppm or less, or 20 wppm or less. The content of nickel and/or vanadium can be 3 wppm or less, or 1 wppm or less. The kinematic viscosity at 100° C. can be at least 15 cSt, or at least 25 cSt, or at least 40 cSt.

Where kerosene/diesel range material generated by hydroprocessing of deasphalted oil is used as a blendstock for low sulfur diesel, gasoil/non-road diesel, or heating oil blending, it may be blended with other streams including/not limited to any of the following, and any combination thereof: low sulfur diesel (sulfur content of less than 500 wppm), ultra low sulfur diesel (sulfur content <10 or <15 ppmw), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated vegetable oil, fatty acid methyl esters. Additionally, additives may be used to correct properties such as pour point, cold filter plugging point, lubricity, cetane, and/or stability.

Where kerosene/diesel, heavy diesel, and/or lubricant boiling range material generated by hydroprocessing of deasphalted oil is used as a blendstock for marine gasoil (MGO) blending, it may be blended with other streams including/not limited to any of the following, and any combination thereof, to make an on-spec marine gasoil fuel: low sulfur diesel (sulfur content of less than 500 wppm), ultra low sulfur diesel (sulfur content <10 or <15 ppmw), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated fats or oils such as hydrotreated vegetable oil, hydrotreated tall oil, etc., fatty acid methyl esters, hydrotreated pyrolysis diesel, hydrotreated pyrolysis gas oil, atmospheric tower bottoms, vacuum tower bottoms and any residue materials derived from low sulfur crude slates, straight-run diesel, straight-run kerosene, straight-run gas oil and any distillates derived from low sulfur crude slates, gas-to-liquid wax, and other gas-to-liquid hydrocarbons. Additionally, additives may be used to correct properties such as pour point, cold filter plugging point, lubricity, cetane, conductivity, and/or stability.

Where bottoms and/or lubricant boiling range material generated by hydroprocessing of deasphalted oil is used as a blendstock for ECA fuel blending, it may be blended with other streams including/not limited to any of the following, and any combinations thereof: low sulfur diesel (sulfur content of less than 500 wppm), ultra low sulfur diesel (sulfur content <10 or <15 ppmw), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated fats or oils such as hydrotreated vegetable oil, hydrotreated tall oil, etc., fatty acid methyl esters, hydrotreated pyrolysis diesel, hydrotreated pyrolysis gas oil, hydrotreated pyrolysis oil, atmospheric tower bottoms, vacuum tower bottoms and any residue materials derived from low sulfur crude slates, straight-run diesel, straight-run kerosene, straight-run gas oil and any distillates derived from low sulfur crude slates, gas-to-liquid wax, and other gas-to-liquid hydrocarbons. Additionally, additives may be used to correct properties such as pour point.

Where bottoms material and/or lubricant boiling range material generated by hydroprocessing of deasphalted oil is used as a blendstock for LSFO (marine fuel oil, <0.5 wt % sulfur) blending, it may be blended with any of the following and any combination thereof: low sulfur diesel (sulfur content of less than 500 wppm), ultra low sulfur diesel (sulfur content <10 or <15 ppmw), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated vegetable oil, fatty acid methyl esters, non-hydrotreated straight-run diesel, non-hydrotreated straight-run kerosene, non-hydrotreated straight-run gas oil and any distillates derived from low sulfur crude slates, gas-to-liquid wax, and other gas-to-liquid hydrocarbons, non-hydrotreated cycle oil, non-hydrotreated fluid catalytic cracking slurry oil, non-hydrotreated pyrolysis gas oil, non-hydrotreated cracked light gas oil, non-hydrotreated cracked heavy gas oil, non-hydrotreated pyrolysis light gas oil, non-hydrotreated pyrolysis heavy gas oil, non-hydrotreated thermally cracked residue, non-hydrotreated thermally cracked heavy distillate, non-hydrotreated coker heavy distillates, non-hydrotreated vacuum gas oil, non-hydrotreated coker diesel, non-hydrotreated coker gasoil, non-hydrotreated coker vacuum gas oil, non-hydrotreated thermally cracked vacuum gas oil, non-hydrotreated thermally cracked diesel, non-hydrotreated thermally cracked gas oil, hydrotreated fats or oils such as hydrotreated vegetable oil, hydrotreated tall oil, etc., fatty acid methyl ester, Group 1 slack waxes, lube oil aromatic extracts, deasphalted oil, atmospheric tower bottoms, vacuum tower bottoms, steam cracker tar, any residue materials derived from low sulfur crude slates, LSFO, RSFO, other LSFO/RSFO blend stocks. Additionally, additives may be used to correct properties such as pour point.

As needed, fuel or fuel blending component fractions generated by hydroprocessing of deasphalted oil and/or other blendstocks may be additized with additives such as pour point improver, cetane improver, lubricity improver, etc. to meet local specifications.

It is noted that due to the nature of the deasphalted oil feed and the subsequent hydroprocessing that is performed, the fuel or fuel blending components described herein can typically have a reduced or minimized content of polar compounds. For example, the content of polar compounds in the total liquid effluent and/or in a given fraction can be 1.0 wt % or less, or 0.1 wt % or less, such as being substantially free of polar compounds. A suitable method for characterizing the aromatics, polars, naphthenes, and/or paraffins in a distillate sample can be ASTM D5186.

Overview of Lubricant Production from Deasphalted Oil

In various aspects, methods are provided for producing fuels and/or lubricant base stocks from deasphalted oils generated by low severity $C_{4+}$ deasphalting. Low severity deasphalting as used herein refers to deasphalting under conditions that result in a high yield of deasphalted oil (and/or a reduced amount of rejected asphalt or rock), such as a deasphalted oil yield of at least 50 wt % relative to the feed to deasphalting, or at least 55 wt %, or at least 60 wt %, or at least 65 wt %, or at least 70 wt %, or at least 75 wt %.

Conventionally, crude oils are often described as being composed of a variety of boiling ranges. Lower boiling range compounds in a crude oil correspond to naphtha or kerosene fuels. Intermediate boiling range distillate compounds can be used as diesel fuel or as lubricant base stocks. If any higher boiling range compounds are present in a crude oil, such compounds are considered as residual or "resid" compounds, corresponding to the portion of a crude oil that is left over after performing atmospheric and/or vacuum distillation on the crude oil.

In some conventional processing schemes, a resid fraction can be deasphalted, with the deasphalted oil used as part of a feed for forming lubricant base stocks. In conventional processing schemes a deasphalted oil used as feed for forming lubricant base stocks is produced using propane deasphalting. This propane deasphalting corresponds to a "high severity" deasphalting, as indicated by a typical yield of deasphalted oil of about 40 wt % or less, often 30 wt % or less, relative to the initial resid fraction. In a typical lubricant base stock production process, the deasphalted oil can then be solvent extracted to reduce the aromatics content, followed by solvent dewaxing to form a base stock. The low yield of deasphalted oil is based in part on the inability of conventional methods to produce lubricant base stocks from lower severity deasphalting that do not form haze over time.

In some aspects, it has been discovered that catalytic processing can be used to produce lubricant base stocks and/or fuels from deasphalted oil while also producing light neutral and/or heavy neutral base stocks that have little or no tendency to form haze over extended periods of time. The deasphalted oil can be produced by deasphalting process that uses a $C_4$ solvent, a $C_5$ solvent, a $C_{6+}$ solvent, a mixture of two or more $C_{4+}$ solvents, or a mixture of two or more $C_{5+}$ solvents. The deasphalting process can further correspond to a process with a yield of deasphalted oil of at least 50 wt % for a vacuum resid feed having a T10 distillation point (or optionally a T5 distillation point) of at least 510° C., or a yield of at least 60 wt %, or at least 65 wt %, or at least 70 wt %. It is believed that the reduced haze formation is due in part to the reduced or minimized differential between the pour point and the cloud point for the base stocks and/or due in part to forming a bright stock with a cloud point of −5° C. or less.

In some aspects a deasphalted oil can be hydroprocessed (hydrotreated and/or hydrocracked), so that ~700° F.+(370° C.+) conversion is 10 wt % to 40 wt %. The hydroprocessed effluent can be fractionated to separate lower boiling portions from a lubricant base stock boiling range portion. The lubricant boiling range portion can then be hydrocracked, dewaxed, and hydrofinished to produce a catalytically dewaxed effluent. Optionally but preferably, the lubricant boiling range portion can be underdewaxed, so that the wax content of the catalytically dewaxed heavier portion or potential bright stock portion of the effluent is at least 6 wt %, or at least 8 wt %, or at least 10 wt %. This underdewaxing can also be suitable for forming light or medium or heavy neutral lubricant base stocks that do not require further solvent upgrading to form haze free base stocks.

In other aspects a deasphalted oil can be hydroprocessed (hydrotreated and/or hydrocracked), so that 370° C.+ conversion is at least 40 wt %, or at least 50 wt %. The hydroprocessed effluent can be fractionated to separate lower boiling portions from a lubricant base stock boiling range portion. The lubricant base stock boiling range portion can then be hydrocracked, dewaxed, and hydrofinished to produce a catalytically dewaxed effluent.

In still other aspects, it has been discovered that catalytic processing can be used to produce Group II bright stock with unexpected compositional properties from $C_3$, $C_4$, $C_5$, and/or $C_{5+}$ deasphalted oil. The deasphalted oil can be hydrotreated to reduce the content of heteroatoms (such as sulfur and nitrogen), followed by catalytic dewaxing under sweet conditions. Optionally, hydrocracking can be included as part of the sour hydrotreatment stage and/or as part of the sweet dewaxing stage.

The systems and methods described herein can be used in "block" operation to allow for additional improvements in yield and/or product quality. During "block" operation, a deasphalted oil and/or the hydroprocessed effluent from the sour processing stage can be split into a plurality of fractions. The fractions can correspond, for example, to feed fractions suitable for forming a light neutral fraction, a heavy neutral fraction, and a bright stock fraction, or the plurality of fractions can correspond to any other convenient split into separate fractions. The plurality of separate fractions can then be processed separately in the process train (or in the sweet portion of the process train) for forming lubricant base stocks. For example, the light neutral portion of the feed can be processed for a period of time, followed by processing of the heavy neutral portion, followed by processing of a bright stock portion. During the time period when one type of fraction is being processed, storage tanks can be used to hold the remaining fractions.

Block operation can allow the processing conditions in the process train to be tailored to each type of lubricant fraction. For example, the amount of sweet processing stage conversion of the heavy neutral fraction can be lower than the amount of sweet processing stage conversion for the light neutral fraction. This can reflect the fact that heavy neutral lubricant base stocks may not need as high a viscosity index as light neutral base stocks.

Another option for modifying the production of base stocks can be to recycle a portion of at least one lubricant base stock product for further processing in the process train. This can correspond to recycling a portion of a base stock product for further processing in the sour stage and/or recycling a portion of a base stock product for further processing in the corresponding sweet stage. Optionally, a base stock product can be recycled for further processing in a different phase of block operation, such as recycling light neutral base stock product formed during block processing of the heavy neutral fraction for further processing during block processing of the light neutral fraction. The amount of base stock product recycled can correspond to any convenient amount of a base stock product effluent from the fractionator, such as 1 wt % to 50 wt % of a base stock product effluent, or 1 wt % to 20 wt %.

Recycling a portion of a base stock product effluent can optionally be used while operating a lube processing system at higher than typical levels of fuels conversion. When using a conventional feed for lubricant production, conversion of feed relative to 370° C. can be limited to 65 wt % or less. Conversion of more than 65 wt % of a feed relative to 370° C. is typically not favored due to loss of viscosity index with additional conversion. At elevated levels of conversion, the loss of VI with additional conversion is believed to be due to cracking and/or conversion of isoparaffins within a feed. For feeds derived from deasphalted oil, however, the amount of isoparaffins within a feed is lower than a conventional feed. As a result, additional conversion can be performed without loss of VI. In some aspects, converting at least 70 wt % of a feed, or at least 75 wt %, or at least 80 wt % can allow for production of lubricant base stocks with substantially improved cold flow properties while still maintaining the viscosity index of the products at a similar value to the viscosity index at a conventional conversion of 60 wt %.

In addition to producing base stocks from block processing of deasphalted oils, some base stocks described herein were produced using an alternative configuration. In the alternative configuration, the starting feed was a heavy vacuum gas oil, such as a vacuum gas oil with a T10 distillation point of 482° C. or higher, or 510° C. or higher. The feed was initially extracted using N-methyl pyrollidone. The raffinate from the extraction process was then hydrotreated, catalytically dewaxed, and hydrofinished. The catalysts used for hydrotreating, dewaxing, and hydrofinishing corresponded to commercially available catalysts.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, conditions may be provided for various types of hydroprocessing of feeds or effluents. Examples of hydroprocessing can include, but are not limited to, one or more of hydrotreating, hydrocracking, catalytic dewaxing, and hydrofinishing/aromatic saturation. Such hydroprocessing conditions can be controlled to have desired values for the conditions (e.g., temperature, pressure, LHSV, treat gas rate) by using at least one controller, such as a plurality of controllers, to control one or more of the hydroprocessing conditions. In some aspects, for a given type of hydroprocessing, at least one controller can be associated with each type of hydroprocessing condition. In some aspects, one or more of the hydroprocessing conditions can be controlled by an associated controller. Examples of structures that can be controlled by a controller can include, but are not limited to, valves that control a flow rate, a pressure, or a combination thereof; heat exchangers and/or heaters that control a temperature; and one or more flow meters and one or more associated valves that control relative flow rates of at least two flows. Such controllers can optionally include a controller feedback loop including at least a processor, a detector for detecting a value of a control variable (e.g., temperature, pressure, flow rate, and a processor output for controlling the value of a manipulated variable (e.g., changing the position of a valve, increasing or decreasing the duty cycle and/or temperature for a heater). Optionally, at least one hydroprocessing condition for a given type of hydroprocessing may not have an associated controller.

In various aspects, at least a portion of a feedstock for processing as described herein can correspond to a vacuum resid fraction or another type 950° F.+(510° C.+) or 1000° F.+(538° C.+) fraction. Another example of a method for forming a 950° F.+(510° C.+) or 1000° F.+(538° C.+) fraction is to perform a high temperature flash separation. The 950° F.+(510° C.+) or 1000° F.+(538° C.+) fraction formed from the high temperature flash can be processed in a manner similar to a vacuum resid.

A vacuum resid fraction or a 950° F.+(510° C.+) fraction formed by another process (such as a flash fractionation bottoms or a bitumen fraction) can be deasphalted at low severity to form a deasphalted oil. Optionally, the feedstock can also include a portion of a conventional feed for lubricant base stock production, such as a vacuum gas oil.

A vacuum resid (or other 510° C.+) fraction can correspond to a fraction with a T5 distillation point (ASTM D2892, or ASTM D7169 if the fraction will not completely elute from a chromatographic system) of at least about 900° F. (482° C.), or at least 950° F. (510° C.), or at least 1000° F. (538° C.). Alternatively, a vacuum resid fraction can be characterized based on a T10 distillation point (ASTM D2892/D7169) of at least about 900° F. (482° C.), or at least 950° F. (510° C.), or at least 1000° F. (538° C.).

Resid (or other 510° C.+) fractions can be high in metals. For example, a resid fraction can be high in total nickel, vanadium and iron contents. In an aspect, a resid fraction can contain at least 0.00005 grams of Ni/V/Fe (50 wppm) or at least 0.0002 grams of Ni/V/Fe (200 wppm) per gram of resid, on a total elemental basis of nickel, vanadium and iron. In other aspects, the heavy oil can contain at least 500 wppm of nickel, vanadium, and iron, such as up to 1000 wppm or more.

Contaminants such as nitrogen and sulfur are typically found in resid (or other 510° C.+) fractions, often in organically-bound form. Nitrogen content can range from about 50 wppm to about 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be at least about 5 wt %, such as at least about 10 wt % or at least about 20 wt %. Additionally or alternately, the Conradson carbon residue of a resid fraction can be about 50 wt % or less, such as about 40 wt % or less or about 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of at least 343° C. and a T95 distillation point of 566° C. or less; or a T10 distillation point of at least 343° C. and a T90 distillation point of 566° C. or less; or a T5 distillation point of at least 370° C. and a T95 distillation point of 566° C. or less; or a T5 distillation point of at least 343° C. and a T95 distillation point of 538° C. or less.

Solvent Deasphalting

Solvent deasphalting is a solvent extraction process. In some aspects, suitable solvents for methods as described herein include alkanes or other hydrocarbons (such as alkenes) containing 4 to 7 carbons per molecule. Examples of suitable solvents include n-butane, isobutane, n-pentane, $C_{4+}$ alkanes, $C_{5+}$ alkanes, $C_{4+}$ hydrocarbons, and $C_{5+}$ hydrocarbons. In other aspects, suitable solvents can include $C_3$ hydrocarbons, such as propane. In such other aspects, examples of suitable solvents include propane, n-butane, isobutane, n-pentane, $C_{3+}$ alkanes, $C_{4+}$ alkanes, $C_{5+}$ alkanes, $C_{3+}$ hydrocarbons, $C_{4+}$ hydrocarbons, and $C_{5+}$ hydrocarbons.

In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent include n-butane and isobutane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %). In aspects where the deasphalting solvent corresponds to a $C_{3+}$ deasphalting solvent, the $C_{3+}$ deasphalting solvent can include less than 10 wt % ethane and/or other $C_2$ hydrocarbons, or less than 5 wt %, or the $C_{3+}$ deasphalting solvent can be substantially free of ethane and/or other $C_2$ hydrocarbons (less than 1 wt %).

Deasphalting of heavy hydrocarbons, such as vacuum resides, is known in the art and practiced commercially. A deasphalting process typically corresponds to contacting a heavy hydrocarbon with an alkane solvent (propane, butane, pentane, hexane, heptane etc and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from about 1:2 to about 1:10, such as about 1:8 or less. Typical solvent deasphalting temperatures range from 40° C. to 200° C., or 40° C. to 150° C., depending on the nature of the feed and the solvent. The pressure during solvent deasphalting can be from about 50 psig (345 kPag) to about 500 psig (3447 kPag).

It is noted that the above solvent deasphalting conditions represent a general range, and the conditions will vary depending on the feed. For example, under typical deasphalting conditions, increasing the temperature can tend to reduce the yield while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In aspects where a $C_3$ deasphalting solvent is used, the yield from solvent deasphalting can be 40 wt % or less. In some aspects, $C_4$ deasphalting can be performed with a yield of deasphalted oil of 50 wt % or less, or 40 wt % or less. In various aspects, the yield of deasphalted oil from solvent deasphalting with a $C_{4+}$ solvent can be at least 50 wt % relative to the weight of the feed to deasphalting, or at least 55 wt %, or at least 60 wt % or at least 65 wt %, or at least 70 wt %. In aspects where the feed to deasphalting includes a vacuum gas oil portion, the yield from solvent deasphalting can be characterized based on a yield by weight of a 950° F.+(510° C.) portion of the deasphalted oil relative to the weight of a 510° C.+ portion of the feed. In such aspects where a $C_{4+}$ solvent is used, the yield of 510° C.+ deasphalted oil from solvent deasphalting can be at least 40 wt % relative to the weight of the 510° C.+ portion of the feed to deasphalting, or at least 50 wt %, or at least 55 wt %, or at least 60 wt % or at least 65 wt %, or at least 70 wt %. In such aspects where a $C_{4-}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less.

Hydrotreating and Hydrocracking

After deasphalting, the deasphalted oil (and any additional fractions combined with the deasphalted oil) can undergo further processing to form lubricant base stocks. This can include hydrotreatment and/or hydrocracking to remove heteroatoms to desired levels, reduce Conradson Carbon content, and/or provide viscosity index (VI) uplift. Depending on the aspect, a deasphalted oil can be hydroprocessed by hydrotreating, hydrocracking, or hydrotreating and hydrocracking. Optionally, one or more catalyst beds and/or stages of demetallization catalyst can be included prior to the initial bed of hydrotreating and/or hydrocracking catalyst. Optionally, the hydroprocessing can further include exposing the deasphalted oil to a base metal aromatic saturation catalyst. It is noted that a base metal aromatic saturation catalyst can sometimes be similar to a lower activity hydrotreating catalyst.

The deasphalted oil can be hydrotreated and/or hydrocracked with little or no solvent extraction being performed prior to and/or after the deasphalting. As a result, the deasphalted oil feed for hydrotreatment and/or hydrocracking can have a substantial aromatics content. In various aspects, the aromatics content of the deasphalted oil feed can be at least 50 wt %, or at least 55 wt %, or at least 60 wt %, or at least 65 wt %, or at least 70 wt %, or at least 75 wt %, such as up to 90 wt % or more. Additionally or alternately, the saturates content of the deasphalted oil feed can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419.

The reaction conditions during demetallization and/or hydrotreatment and/or hydrocracking of the deasphalted oil (and optional vacuum gas oil co-feed) can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages for the deasphalted oil. Suitable amounts of conversion of molecules boiling above 1050° F. (566° C.) to molecules boiling below 566° C. include 30 wt % to 90 wt % conversion relative to 566° C., or 30 wt % to 80 wt %, or 30 wt % to 70 wt %, or 40 wt % to 90 wt %, or 40 wt % to 80 wt %, or 40 wt % to 70 wt %, or 50 wt % to 90 wt %, or 50 wt % to 80 wt %, or 50 wt % to 70 wt %. In particular, the amount of conversion relative to 566° C. can be 30 wt % to 90 wt %, or 30 wt % to 70 wt %, or 50 wt % to 90 wt %. Additionally or alternately, suitable amounts of conversion of molecules boiling above ~700° F. (370° C.) to molecules boiling below 370° C. include 10 wt % to 70 wt % conversion relative to 370° C., or 10 wt % to 60 wt %, or 10 wt % to 50 wt %, or 20 wt % to 70 wt %, or 20 wt % to 60 wt %, or 20 wt % to 50 wt %, or 30 wt % to 70 wt %, or 30 wt % to 60 wt %, or 30 wt % to 50 wt %. In particular, the amount of conversion relative to 370° C. can be 10 wt % to 70 wt %, or 20 wt % to 50 wt %, or 30 wt % to 60 wt %.

The hydroprocessed deasphalted oil can also be characterized based on the product quality. After hydroprocessing (hydrotreating and/or hydrocracking), the hydroprocessed deasphalted oil can have a sulfur content of 200 wppm or less, or 100 wppm or less, or 50 wppm or less (such as down to ~0 wppm). Additionally or alternately, the hydroprocessed deasphalted oil can have a nitrogen content of 200 wppm or less, or 100 wppm or less, or 50 wppm or less (such as down to ~0 wppm). Additionally or alternately, the hydroprocessed deasphalted oil can have a Conradson Carbon residue content of 1.5 wt % or less, or 1.0 wt % or less, or 0.7 wt % or less, or 0.1 wt % or less, or 0.02 wt % or less (such as down to ~0 wt %). Conradson Carbon residue content can be determined according to ASTM D4530.

In various aspects, a feed can initially be exposed to a demetallization catalyst prior to exposing the feed to a hydrotreating catalyst. Deasphalted oils can have metals concentrations (Ni+V+Fe) on the order of 10-100 wppm. Exposing a conventional hydrotreating catalyst to a feed having a metals content of 10 wppm or more can lead to catalyst deactivation at a faster rate than may desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, the deasphalted oil can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 200 SCF/B (34 $Nm^3/m^3$) to about 2500 SCF/B (420 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In various aspects, the deasphalted oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 to 10 and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

Additional Hydroprocessing—Catalytic Dewaxing, Hydrofinishing, and Optional Hydrocracking At least a lubricant boiling range portion of the hydroprocessed deasphalted oil can be exposed to further hydroprocessing (including catalytic dewaxing) to form base stocks, including light neutral and heavy neutral base stocks as well as Group I and/or Group II bright stock. In some aspects, a first lubricant boiling range portion of the hydroprocessed deasphalted oil can be solvent dewaxed as described above while a second lubricant boiling range portion can be exposed to further hydroprocessing. In other aspects, only solvent dewaxing or only further hydroprocessing can be used to treat a lubricant boiling range portion of the hydroprocessed deasphalted oil.

Optionally, the further hydroprocessing of the lubricant boiling range portion of the hydroprocessed deasphalted oil can also include exposure to hydrocracking conditions before and/or after the exposure to the catalytic dewaxing conditions. At this point in the process, the hydrocracking can be considered "sweet" hydrocracking, as the hydroprocessed deasphalted oil can have a sulfur content of 200 wppm or less.

Suitable hydrocracking conditions can include exposing the feed to a hydrocracking catalyst as previously described above. Optionally, it can be preferable to use a USY zeolite with a silica to alumina ratio of at least 30 and a unit cell size of less than 24.32 Angstroms as the zeolite for the hydrocracking catalyst, in order to improve the VI uplift from hydrocracking and/or to improve the ratio of distillate fuel yield to naphtha fuel yield in the fuels boiling range product.

Suitable hydrocracking conditions can also include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 V, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

For catalytic dewaxing, suitable dewaxing catalysts can include molecular sieves such as crystalline aluminosilicates (zeolites). In an embodiment, the molecular sieve can comprise, consist essentially of, or be ZSM-22, ZSM-23, ZSM-48. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various embodiments, the catalysts according to the invention further include a metal hydrogenation component. The metal hydrogenation component is typically a Group VI and/or a Group VIII metal. Preferably, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

Without being bound by any particular theory, it is believed that use of a low surface area binder reduces the amount of binder surface area available for the hydrogenation metals supported on the catalyst. This leads to an increase in the amount of hydrogenation metals that are supported within the pores of the molecular sieve in the catalyst.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 280° C. to 450° C., preferably 343° C. to 435° C., a hydrogen partial pressure of from 3.5 MPag to 34.6 MPag (500 psig to 5000 psig), preferably 4.8 MPag to 20.8 MPag, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Before and/or after catalytic dewaxing, the hydroprocessed deasphalted oil (i.e., at least a lubricant boiling range portion thereof) can optionally be exposed to an aromatic saturation catalyst, which can alternatively be referred to as a hydrofinishing catalyst. Exposure to the aromatic saturation catalyst can occur either before or after fractionation. If aromatic saturation occurs after fractionation, the aromatic saturation can be performed on one or more portions of the fractionated product. Alternatively, the entire effluent from the last hydrocracking or dewaxing process can be hydrofinished and/or undergo aromatic saturation.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. For supported hydrotreating catalysts, suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Examples of Hydroprocessed Deasphalted Oil Fractions

Hydroprocessed deasphalted oil fractions were produced using a configuration similar to FIGS. 1 to 3. The configuration corresponded to a two-stage processing configuration with block operation. During formation of the hydroprocessed deasphalted oils in this example, a high yield deasphalted oil was processed in a first sour stage by exposing the feed to a demetallization catalyst, a hydrotreatment catalyst, and a hydrocracking catalyst. The lubricant boiling range portion (and higher) of the effluent was then processed in a second sweet stage using block operation to allow for separate processing conditions for the light neutral, heavy neutral, and bright stock base stocks. The blocked feeds (such as a light neutral feed, heavy neutral feed, or bright stock feed) were then passed into the second stage and exposed to an aromatic saturation catalyst, a hydrocracking catalyst, a dewaxing catalyst, and another portion of the aromatic saturation catalyst. This resulted in production of light neutral base stock, heavy neutral base stock, and bright stock, according to the nature of the blocked feed. The aromatic saturation catalyst was a commercially available aromatic saturation catalyst including Pt on a mixed metal oxide. The dewaxing catalyst was a catalyst that dewaxes primarily by isomerization, and also included supported Pt. The hydrocracking catalyst included Pt on a support including USY.

In addition to the primary lubricant product based on the nature of the blocked feed, processing in the second stage also resulted in production of additional fuels and/or light neutral base stock and/or heavy neutral base stock. The additional fuels and/or light neutral base stock and/or heavy neutral base stock were generated due to the additional conversion occurring in the second stage.

Various fractions of the effluents generated during hydroprocessing of a $C_5$ deasphalted oil were characterized for suitability in forming fuels and/or blended fuel products. For some heavier samples, compositional analysis was performed using a "STAR7" technique, as described in U.S. Pat. No. 8,114,678, which is incorporated herein by reference for the limited purpose of defining the STAR7 technique. Briefly, STAR 7 refers to an automated analytical high performance liquid chromatographic (HPLC) method for rapid quantitative determination of seven classes of compounds present in heavy petroleum streams boiling between 550° F. (288° C.) and 1050° F. (566° C.), This boiling range includes vacuum gas oil (VGO) and/or lubricant boiling range samples. The seven classes of compounds are: 'Saturates', 'Aromatic-Ring-Classes 1-4 (4 fractions)', 'Sulfides', and 'Polars', Results from this type of analysis relate to the compositional analysis of both refinery and research samples. Synthesis refers to a data reconciliation procedure in which a detailed model-of-composition is adjusted to match analytical test results referred to as targets. Models-of-composition and a data reconciliation procedure are described in US 2007/0114377A1, Micro-Hydrocarbon Analysis. STAR7 provides seven analytical test results that are used in the reconciliation process. STAR7 may be employed as part of the analytical protocol used in developing a model of composition for a hydrocarbon sample. In addition, STAR7 can provide targets to which a reference model-of-composition is reconciled in estimating; a model-of-composition for a sample under test.

Table 1 shows examples of naphtha boiling range fractions generated during hydroprocessing of three different deasphalted oils in the first (sour) stage.

TABLE 1

1st Stage Naphtha Properties

| Property | Units | 1st Stage Naphtha 1 | 1st Stage Naphtha 2 | 1st Stage Naphtha 3 |
|---|---|---|---|---|
| API Gravity | — | 55.50 | 56.60 | 54.49 |
| GC Distillation | | | | |
| Temperature, 10% off | ° C. | 80 | 79 | 93 |
| Temperature, 50% off | ° C. | 125 | 122 | 131 |
| Temperature, 90% off | ° C. | 165 | 158 | 167 |
| Silicon Content | ppm | 0.0 | — | — |
| Phosphorus Content | gal/US gal | <0.0008 | — | — |
| Lead Content | gal/US gal | <0.010 | — | — |
| Composition | | | | |
| Isoparaffin | wt % | 21.04 | 22.42 | 20.62 |
| n-paraffin | wt % | 12.99 | 12.92 | 13.40 |
| Naphthenes | wt % | 59.34 | 59.52 | 56.99 |
| Aromatics | wt % | 5.46 | 4.62 | 8.17 |

As shown in Table 1, the naphtha fractions have API Gravity values between 54° and 57°. The boiling ranges are representative of naphtha with only a modest amount of kerosene boiling range components. The naphtha fractions have a naphthenes content of 55 wt % to 60 wt %, while having a relatively low aromatics content of less than 10 wt %.

Table 2 shows properties for kerosene boiling range fractions derived from the effluent from the first (sour) hydroprocessing stage of processing of various deasphalted oils.

TABLE 2

1st Stage Kerosene Properties

| Property | Units | 1st Stage Kero 1 | 1st Stage Kero 2 | 1st Stage Kero 3 |
|---|---|---|---|---|
| Density at 15.6° C. | g/cc | 0.8282 | 0.8342 | — |
| Smoke Point | Mm | 25.5 | 23.0 | 23.5 |
| Freeze Point | ° C. | −66.8 | −54.6 | −53.2 |
| Sulfur Content | mg/kg | 10 | 4 | 2 |
| Nitrogen Content | mg/kg | 0.5 | 0.41 | 0.03 |
| Distillation | | | | |
| Temperature, 10% off | ° C. | 198.6 | 202.3 | 201.1 |
| Temperature, 50% off | ° C. | 216.4 | 225.6 | 228.1 |
| Temperature, 90% off | ° C. | 241.9 | 254.3 | 258.3 |
| Kinematic Viscosity at 40° C. | cSt | 1.643 | 1.768 | 1.824 |
| Composition | | | | |
| Paraffins | wt % | 18.19 | 18.27 | 18.19 |
| 1-Ring Naphthenes | wt % | 30.3 | 27.26 | 29.5 |
| 2+ Ring Naphthenes | wt % | 43.8 | 41.38 | 41.43 |
| 1-Ring Aromatics | wt % | 7.25 | 11.84 | 9.81 |
| 2-Ring Aromatics | wt % | 0.46 | 1.11 | 0.93 |
| 3+ Ring Aromatics | wt % | 0 | 0.14 | 0.15 |
| Total Naphthenes | wt % | 74.1 | 68.64 | 70.93 |
| Total Aromatics | wt % | 7.71 | 13.09 | 10.88 |

The kerosene fractions shown in Table 2 have freeze points of −50° C. or less. The total naphthenes are 68 wt % or more, while the total aromatics are 15 wt % or less of the kerosene fraction. The kerosene fractions have a density at 15° C. of 0.81 g/cm$^3$ to 0.84 g/cm$^3$.

Table 3 shows properties for diesel boiling range fractions derived from the effluent from the first (sour) hydroprocessing stage of processing of various deasphalted oils.

TABLE 3

1st Stage Diesel Properties

| Property | Units | 1st Stage Diesel 1 | 1st Stage Diesel 2 | 1st Stage Diesel 3 |
|---|---|---|---|---|
| Density at 15.6° C. | g/cc | 0.8602 | 0.8644 | 0.8584 |
| Smoke Point | Mm | 23.0 | 19.0 | 19.5 |
| Sulfur Content | mg/kg | 8.9 | 6.1 | 2.8 |
| Nitrogen Content | mg/kg | 0.73 | 0.61 | 0.05 |
| Flash Point, Pensky Marten | ° C. | 144 | 150 | 95 |
| Cloud Point | ° C. | −10.4 | −9.4 | −7.6 |
| Pour Point | ° C. | −33 | −22 | −18 |
| Cetane Index, 2-Number | — | 51.6 | 50.9 | 53.0 |
| Distillation | | | | |
| Temperature, 10% off | ° C. | 293.6 | 303 | 307.1 |
| Temperature, 50% off | ° C. | 311.8 | 316.8 | 318.9 |
| Temperature, 90% off | ° C. | 344 | 344 | 343.2 |
| Kinematic Viscosity at 40° C. | cSt | 6.381 | 6.888 | 7.093 |
| Composition | | | | |
| Paraffins | wt % | 14.14 | 15.09 | 16.03 |
| 1-Ring Naphthenes | wt % | 27 | 26.25 | 25.37 |
| 2+ Ring Naphthenes | wt % | 48.28 | 43.45 | 47.7 |
| 1-Ring Aromatics | wt % | 7.99 | 10.77 | 8.01 |
| 2-Ring Aromatics | wt % | 1.32 | 2.06 | 1.18 |
| 3+ Ring Aromatics | wt % | 1.26 | 2.39 | 1.71 |
| Total Naphthenes | wt % | 75.28 | 69.69 | 73.07 |
| Total Aromatics | wt % | 10.58 | 15.22 | 10.9 |

The diesel fractions shown in Table 3 have a sulfur content of less than 10 wppm and a cetane index of 50 or more. The diesel fractions have a density at 15° C. of 0.85 g/cm$^3$ to 0.87 g/cm$^3$ and a kinematic viscosity at 40° C. of 6.0 cSt to 7.5 cSt. The diesel fractions have cloud points of −5° C. to −10° C. and pour points of −15° C. to −35° C. The diesel fractions have a total naphthenes content of 66 wt % to 76 wt % and a total aromatics content of 16 wt % or less.

Table 4 shows properties for lubricant boiling range fractions derived from the effluent from the first (sour) hydroprocessing stage of processing various deasphalted oils. The lubricant boiling range fractions in Table 4 correspond to fractions with suitable viscosity for processing during blocked operation in a sweet stage for production of light neutral lubricant base stocks

TABLE 4

1st Stage Heavy Product - Feed for LN production

| Property | Units | 1st Stage LN Feed 1 | 1st Stage LN Feed 2 |
|---|---|---|---|
| Density at 15° C. | g/cc | 0.8688 | 0.8733* |
| Sulfur Content | mg/kg | <5 | 5.3 |
| Nitrogen Content | mg/kg | <10 | <10 |
| GC Distillation | | | |
| Temperature, 10% off | ° C. | 368.9 | 378.4 |
| Temperature, 50% off | ° C. | 430.1 | 420.5 |
| Temperature, 90% off | ° C. | 492.7 | 481.8 |
| Kinematic Viscosity at 40° C. | cSt | 29.7* | 32.8* |
| Kinematic Viscosity at 100° C. | cSt | 5.4006 | 5.6065 |
| Viscosity Index | — | 117.4 | 109.0 |
| CCAI | — | 771 | 773 |

TABLE 4-continued

| 1st Stage Heavy Product - Feed for LN production | | | |
|---|---|---|---|
| Property | Units | 1st Stage LN Feed 1 | 1st Stage LN Feed 2 |
| Composition, STAR7 | | | |
| Saturates | wt % | 93.9 | 89.1 |
| ARC1 | wt % | 5.5 | 7.7 |
| ARC2 | wt % | 0.5 | 1.4 |
| ARC3 | wt % | 0.0 | 1.8 |
| ARC4 | wt % | 0.0 | 0.0 |
| Sulfides | wt % | 0.0 | 0.0 |
| Polars | wt % | 0.0 | 0.0 |

In Table 4, values noted with an asterisk correspond to values that were estimated for the fraction. ARC refers to aromatic ring class, corresponding to the number of aromatic rings present in an aromatic compound. The light neutral feed fractions had kinematic viscosities at 100° C. of 5.3 cSt to 5.7 cSt and viscosity index values of 110 to 120. The sulfur and nitrogen contents were 10 wppm or less. The densities at 15° C. were 0.86 g/cm$^3$ to 0.88 g/cm$^3$. The fractions had calculated carbon aromaticity index values of less than 780. The saturates content of the fractions were greater than 88 wt %.

Table 5 shows properties for lubricant boiling range fractions derived from the effluent from the first (sour) hydroprocessing stage of processing various deasphalted oils. The lubricant boiling range fractions in Table 5 correspond to fractions with suitable viscosity for processing during blocked operation in a sweet stage for production of heavy neutral lubricant base stocks.

TABLE 5

| 1st Stage Heavy Product - Feed for HN production | | | |
|---|---|---|---|
| Property | Units | 1st Stage HN Feed 1 | 1st Stage HN Feed 2 |
| Density at 15° C. | g/cc | 0.8705 | 0.8757* |
| Sulfur Content | mg/kg | <5 | 6.1 |
| Nitrogen Content | mg/kg | <10 | <10 |
| GC Distillation | | | |
| Temperature, 10% off | ° C. | 457.1 | 432.1 |
| Temperature, 50% off | ° C. | 513.7 | 501.4 |
| Temperature, 90% off | ° C. | 567.8 | 557.4 |
| Kinematic Viscosity at 40° C. | cSt | 87.1* | 88.7* |
| Kinematic Viscosity at 100° C. | cSt | 11.095 | 10.967 |
| Viscosity Index | — | 114.3 | 109.3 |
| CCAI | — | 755 | 760 |
| Composition, STAR7 | | | |
| Saturates | wt % | 91.7 | 88.0 |
| ARC1 | wt % | 7.8 | 9.5 |
| ARC2 | wt % | 0.4 | 1.4 |
| ARC3 | wt % | 0.0 | 1.1 |
| ARC4 | wt % | 0.0 | 0.0 |
| Sulfides | wt % | 0.0 | 0.0 |
| Polars | wt % | 0.0 | 0.0 |

In Table 5, values noted with an asterisk correspond to values that were estimated for the fraction. ARC refers to aromatic ring class, corresponding to the number of aromatic rings present in an aromatic compound. The heavy neutral feed fractions had kinematic viscosities at 100° C. of 10.8 cSt to 11.2 cSt and viscosity index values of 105 to 115. The sulfur and nitrogen contents were 10 wppm or less. The densities at 15° C. were 0.86 g/cm$^3$ to 0.88 g/cm$^3$. The fractions had calculated carbon aromaticity index values of 760 or less. The saturates content of the fractions was 88 wt % or more.

Table 6 shows properties for lubricant boiling range fractions derived from the effluent from the first (sour) hydroprocessing stage of processing various deasphalted oils. The lubricant boiling range fractions in Table 6 correspond to fractions with suitable viscosity for processing during blocked operation in a sweet stage for production of bright stocks.

TABLE 6

| 1st Stage Heavy Product - Feed for BS production | | | |
|---|---|---|---|
| Property | Units | 1st Stage BS Feed 1 | 1st Stage BS Feed 2 |
| Density at 15° C. | g/cc | 0.8769* | 0.8807* |
| Sulfur Content | mg/kg | <5 | 7.9 |
| Nitrogen Content | mg/kg | <10 | <10 |
| Carbon Residue | wt % | 0.02 | 0.28 |
| GC Distillation | | | |
| Temperature, 10% off | ° F. | 1017 | 1017 |
| Temperature, 50% off | ° F. | 1139 | 1136 |
| Temperature, 90% off | ° F. | 1305 | 1280 |
| Kinematic Viscosity at 40° C. | cSt | 369.8* | 408.9* |
| Kinematic Viscosity at 100° C. | cSt | 31.647 | 33.175 |
| Viscosity Index | — | 121.2 | 117.9 |
| CCAI | — | 740 | 743 |
| Composition, STAR7 | | | |
| Saturates | wt % | 87.2 | 81.6 |
| ARC1 | wt % | 11.9 | 17.1 |
| ARC2 | wt % | 0.9 | 1.2 |
| ARC3 | wt % | 0 | 0.0 |
| ARC4 | wt % | 0 | 0.0 |
| Sulfides | wt % | 0 | 0.0 |
| Polars | wt % | 0 | 0.0 |

In Table 6, values noted with an asterisk correspond to values that were estimated for the fraction. ARC refers to aromatic ring class, corresponding to the number of aromatic rings present in an aromatic compound. The bright stock feed fractions had kinematic viscosities at 100° C. of 31 cSt to 34 cSt and viscosity index values of 115 to 125. The sulfur and nitrogen contents were 10 wppm or less. The densities at 15° C. were 0.87 g/cm$^3$ to 0.89 g/cm$^3$. The fractions had calculated carbon aromaticity index values of 750 or less. The saturates content of the fractions was 81 wt % or more.

Table 7 shows properties for diesel boiling range fractions derived from the effluent from the second (sweet) hydroprocessing stage during processing of the lubricant boiling range feeds. The diesel boiling range fractions were produced due to additional conversion that occurred during sweet stage processing of the lubricant feeds during block processing.

TABLE 7

| 2nd Stage Diesel Properties | | | |
|---|---|---|---|
| Property | Units | 2nd Stage Diesel 1 | 2nd Stage Diesel 2 |
| Density at 15.6° C. | g/cc | 0.8479 | 0.8139 |
| Sulfur Content | mg/kg | <0.2 | <0.2 |
| Cetane Index, 2-number equation | — | 59.9 | 65.3 |
| GC Distillation | | | |
| Temperature, 10% off | ° C. | 227.6 | 209.4 |
| Temperature, 50% off | ° C. | 365.9 | 295.9 |
| Temperature, 90% off | ° C. | 411.9 | 392.4 |
| Kinematic Viscosity at 40° C. | cSt | 7.139 | 3.729 |
| Flash Point, Continuous Closed Cup | ° C. | 92.2 | 86.2 |

TABLE 7-continued

| 2nd Stage Diesel Properties | | | |
|---|---|---|---|
| Property | Units | 2nd Stage Diesel 1 | 2nd Stage Diesel 2 |
| Pour Point | ° C. | −35 | <−50 |
| Cloud Point | ° C. | −30.4 | −53.0 |
| Composition | | | |
| Paraffins | wt % | 21.66 | 43.50 |
| 1-Ring Naphthenes | wt % | 29.71 | 26.72 |
| 2+ Ring Naphthenes | wt % | 48.62 | 29.78 |
| Total Naphthenes | wt % | 78.34 | 56.50 |
| Total Aromatics | wt % | 0.00 | 0.00 |

The diesel fractions shown in Table 7 have a sulfur content of less than 10 wppm and a cetane index of 55 or more, or 60 or more. The diesel fractions have a density at 15° C. of 0.81 g/cm$^3$ to 0.85 g/cm$^3$ and a kinematic viscosity at 40° C. of 3.5 cSt to 7.5 cSt. The diesel fractions have cloud points of −30° C. to −55° C. and pour points of −35° C. or less. The diesel fractions have a total naphthenes content of 55 wt % to 80 wt % and a total aromatics content of 1 wt % or less.

Table 8 shows predicted properties for a heavy diesel boiling range fraction derived from the effluent from a second (sweet) hydroprocessing stage during processing of a lubricant boiling range feed. The predicted properties were generated using an empirical model based on both laboratory scale and commercial scale data. The predicted heavy diesel boiling range fraction was produced due to additional conversion that occurred during sweet stage processing of a lubricant feed during block processing.

TABLE 8

| 2nd Stage Heavy Diesel Properties | | |
|---|---|---|
| Property | Units | 2nd Stage Heavy Diesel Predicted Properties |
| Specific Gravity at 60° F./15.6° C. | — | 0.8549 |
| Sulfur Content | mg/kg | 0.00953 |
| Nitrogen Content | mg/kg | 0.00433 |
| Cetane Index, 2-number equation | — | 58.3 |
| GC Distillation | | |
| Temperature, 10% off | ° C. | 372.2 |
| Temperature, 50% off | ° C. | 405.6 |
| Temperature, 90% off | ° C. | 430.6 |
| Kinematic Viscosity at 40° C. | cSt | About 22-24 |
| Kinematic Viscosity at 100° C. | cSt | About 3-5 |
| Composition | | |
| Paraffins | wt % | 48.18 |
| Olefins | wt % | 0 |
| Naphthenes | wt % | 51.82 |
| Aromatics | wt % | 0.000649 |

The predicted heavy diesel fraction shown in Table 8 has a sulfur content of less than 1 wppm and a cetane index of 55 or more. The predicted heavy diesel fraction has a density at 15.6° C. of roughly 0.85 g/cm$^3$ and a kinematic viscosity at 40° C. of 22 cSt to 24 cSt and/or kinematic viscosity at 100° C. of 3 cSt to 5 cSt. The predicted heavy diesel fraction has a total naphthenes content of roughly 50 wt % or more wt % and a total aromatics content of 1 wt % or less.

Table 9 shows properties for lubricant boiling range fractions from block processing of the light neutral feed in the second (sweet) hydroprocessing stage.

TABLE 9

| 2nd Stage Heavy Product - Light Neutral | | | |
|---|---|---|---|
| Property | Units | 2nd Stage LN 1 | 2nd Stage LN 2 |
| Density at 15° C. | g/cc | 0.8582 | 0.8578 |
| Cloud Point | ° C. | −19 | −21 |
| Pour Point | ° C. | −20 | −21 |
| Saybolt Color | — | 30 | 27 |
| Sulfur Content | mg/kg | <10* | <10* |
| Nitrogen Content | mg/kg | <10* | <10* |
| GC Distillation | | | |
| Temperature, 10% off | ° C. | 367.3 | 378 |
| Temperature, 50% off | ° C. | 424.6 | 426.4 |
| Temperature, 90% off | ° C. | 486.3 | 487.9 |
| Kinematic Viscosity at 40° C. | cSt | 29.62 | 30.14 |
| Kinematic Viscosity at 100° C. | cSt | 5.273 | 5.339 |
| Viscosity Index | — | 111.0 | 110.2 |
| CCAI | — | 760 | 759 |
| Composition | | | — |
| Paraffins | wt % | 15.6 | — |
| 1-Ring naphthenes | wt % | 50.5 | — |
| 2+ Ring Naphthenes | wt % | 34.0 | — |
| Total Naphthenes | wt % | 84.4 | — |

In Table 9, values noted with an asterisk correspond to values that were estimated for the fraction. The light neutral product fractions had kinematic viscosities at 100° C. of 5.0 cSt to 5.4 cSt and viscosity index values of 108 to 115. The sulfur and nitrogen contents were 10 wppm or less. The densities at 15° C. were 0.85 g/cm$^3$ to 0.86 g/cm$^3$. The cloud points and pour points were −18° C. to −22° C. The fractions had calculated carbon aromaticity index values of 760 or less. The naphthenes content of one of the fractions was greater than 84 wt %. The aromatics contents of the fractions were less than 1 wt %.

Table 10 shows properties for lubricant boiling range fractions from block processing of the heavy neutral feed in the second (sweet) hydroprocessing stage.

TABLE 10

| 2nd Stage Heavy Product - HN | | | |
|---|---|---|---|
| Property | Units | 2nd Stage HN 1 | 2nd Stage HN 2 |
| Density at 15° C. | g/cc | 0.8697 | 0.8695 |
| Cloud Point | ° C. | −9 | −10 |
| Pour Point | ° C. | −12 | −12 |
| Saybolt Color | — | 25 | 26 |
| Sulfur Content | mg/kg | <10* | <10* |
| Nitrogen Content | mg/kg | <10* | <10* |
| Carbon Residue | mass % | 0.01 | — |
| GC Distillation | | | |
| Temperature, 10% off | ° C. | 451.8 | 443.8 |
| Temperature, 50% off | ° C. | 508 | 504.8 |
| Temperature, 90% off | ° C. | 559 | 556.6 |
| Kinematic Viscosity at 40° C. | cSt | 103.89 | 98.493 |
| Kinematic Viscosity at 100° C. | cSt | 11.970 | 11.581 |
| Viscosity Index | — | 104.6 | 105.4 |
| CCAI | — | 752 | 753 |
| Property | Units | 2nd Stage HN 3 | — |
| Composition | | | — |
| Paraffins | wt % | 17.9 | — |
| 1-Ring naphthenes | wt % | 45.3 | — |
| 2+ Ring Naphthenes | wt % | 36.8 | — |
| Total Naphthenes | wt % | 82.1 | — |

In Table 10, values noted with an asterisk correspond to values that were estimated for the fraction. The heavy neutral product fractions had kinematic viscosities at 100° C. of 11.5 cSt to 12.0 cSt and viscosity index values of 102 to 108. The sulfur and nitrogen contents were 10 wppm or less. The densities at 15° C. were 0.86 g/cm$^3$ to 0.87 g/cm$^3$. The cloud points were −8° C. to −10° C. and the pour points were roughly −12° C. The fractions had calculated carbon aromaticity index values of 755 or less. An additional heavy neutral product fraction was analyzed for composition details. The naphthenes content of the additional heavy neutral product fraction was greater than 82 wt %. The aromatics contents of the fractions were less than 1 wt %.

Table 11 shows properties for lubricant boiling range fractions from block processing of the bright stock feed in the second (sweet) hydroprocessing stage. The product fractions correspond to additional light neutral base stock product fractions generated due to additional conversion during processing of the bright stock feed. It is noted that the properties for the second fraction shown in Table 11 correspond to predicted properties based on use of the empirical model.

TABLE 11

2$^{nd}$ Stage Heavy Product - BS Light Cracked Product

| Property | Units | 2$^{nd}$ Stage BS Light Cracked Product 1 | 2$^{nd}$ Stage BS Light Cracked Product 2 (Predicted) |
|---|---|---|---|
| Specific Gravity at 60° F./15.6° C. | — | — | 0.8582 |
| Density at 15° C. | g/cc | 0.8566 | — |
| Cloud Point | ° C. | −50.0 | — |
| Sulfur Content | mg/kg | <10* | 0.00889 |
| Nitrogen Content | mg/kg | <10* | 0.00906 |
| GC Distillation | | | |
| Temperature, 10% off | ° C. | 398 | 415.6 |
| Temperature, 50% off | ° C. | 453.8 | 433.9 |
| Temperature, 90% off | ° C. | 507.2 | 455 |
| Kinematic Viscosity at 40° C. | cSt | 42.0 | About 32-35 |
| Kinematic Viscosity at 100° C. | cSt | 6.49 | About 4-6 |
| Viscosity Index | — | 104.4 | — |
| CCAI | — | 752.2 | About 757-759 |
| Composition | | | |
| Paraffins | wt % | 18.0 | 46.13 |
| Olefins | wt % | — | 0 |
| 1-Ring naphthenes | wt % | 49.9 | — |
| 2+ Ring Naphthenes | wt % | 32.1 | — |
| Total Naphthenes | wt % | 82.0 | 53.87 |

In Table 11, values noted with an asterisk correspond to values that were estimated for the fraction. The light neutral product fractions had kinematic viscosities at 100° C. of roughly 4.0 cSt to 6.5 cSt and a viscosity index value of 102 to 106. The sulfur and nitrogen contents were 10 wppm or less. The densities at 15° C. were 0.85 g/cm$^3$ to 0.86 g/cm$^3$. The cloud point of the first product fraction was −50° C. The fractions had calculated carbon aromaticity index values of 760 or less. The naphthenes content of one of the fractions was greater than 81 wt %, while the predicted fraction had a lower naphthenes content of 53 wt % or more. The aromatics contents of the fractions were less than 1 wt %.

Table 12 shows properties for a lubricant boiling range fraction from block processing of the bright stock feed in the second (sweet) hydroprocessing stage. The product fraction corresponds to additional heavy neutral base stock product fractions generated due to additional conversion during processing of the bright stock feed.

TABLE 12

2$^{nd}$ Stage Heavy Product -BS Heavy Cracked Product

| Property | Units | 2$^{nd}$ Stage BS Heavy Cracked Product 1 |
|---|---|---|
| Density at 15° C. | g/cc | 0.8653 |
| Pour Point | ° C. | −42.0 |
| Sulfur Content | mg/kg | <10* |
| Nitrogen Content | mg/kg | <10* |
| GC Distillation | | |
| Temperature, 10% off | ° C. | 463.1 |
| Temperature, 50% off | ° C. | 511.1 |
| Temperature, 90% off | ° C. | 554.8 |
| Kinematic Viscosity at 40° C. | cSt | 105.62 |
| Kinematic Viscosity at 100° C. | cSt | 11.746 |
| Viscosity Index | — | 99.0 |
| CCAI | — | 747.6 |
| Composition | | |
| Paraffins | wt % | 25.3 |
| 1-Ring naphthenes | wt % | 40.6 |
| 2+ Ring Naphthenes | wt % | 34.1 |
| Total Naphthenes | wt % | 74.7 |

In Table 12, values noted with an asterisk correspond to values that were estimated for the fraction. The heavy neutral product fraction had a kinematic viscosity at 100° C. of 11.5 cSt to 12.0 cSt and a viscosity index value of 96 to 101. The sulfur and nitrogen contents were 10 wppm or less. The density at 15° C. was 0.86 g/cm$^3$ to 0.87 g/cm$^3$. The pour point was roughly −40° C. or lower. The fraction had a calculated carbon aromaticity index value of 750 or less. The naphthenes content was greater than 74 wt %. The aromatics contents of the fraction was less than 1 wt %.

Table 13 shows properties for a lubricant boiling range fraction from block processing of the bright stock feed in the second (sweet) hydroprocessing stage.

TABLE 13

2$^{nd}$ Stage Heavy Product - BS

| Property | Units | 2$^{nd}$ Stage BS 1 | 2$^{nd}$ Stage BS 2 |
|---|---|---|---|
| Density at 15° C. | g/cc | 0.8779 | 0.8786 |
| Cloud Point | ° C. | <−60 | <−60 |
| Pour Point | ° C. | −27, −29, −29 | −30, −31, −32 |
| Appearance | — | Clear and Bright | Clear and Bright |
| Saybolt Color | — | 15 | — |
| Sulfur Content | mg/kg | <10* | <10* |
| Nitrogen Content | mg/kg | <10* | <10* |
| Carbon Residue | mass % | 0.02 | 0.03 |
| GC Distillation | | | |
| Temperature, 10% off | ° C. | 504 | 518 |
| Temperature, 50% off | ° C. | 601 | 600 |
| Temperature, 90% off | ° C. | 700 | 678 |
| Kinematic Viscosity at 40° C. | cSt | 459.25 | 527.22 |
| Kinematic Viscosity at 100° C. | cSt | 32.067 | 34.823 |
| Viscosity Index | — | 101.4 | 100.2 |
| CCAI | — | 743 | 742 |

TABLE 13-continued

| 2nd Stage Heavy Product - BS | | | |
|---|---|---|---|
| Property | Units | 2nd Stage BS 3 | — |
| Composition | | | |
| Paraffins | wt % | 6.5 | — |
| 1-Ring naphthenes | wt % | 15.1 | — |
| 2+ Ring Naphthenes | wt % | 78.3 | — |
| Total Naphthenes | wt % | 93.5 | — |

In Table 13, values noted with an asterisk correspond to values that were estimated for the fraction. The bright stock product fractions had kinematic viscosities at 100° C. of 32 cSt to 35 cSt and viscosity index values of 98 to 103. The sulfur and nitrogen contents were 10 wppm or less. The densities at 15° C. were 0.85 g/cm$^3$ to 0.86 g/cm$^3$. The cloud points were less than −60° C. and the pour points were −27° C. to −33° C. The fractions had calculated carbon aromaticity index values of 745 or less. An additional bright stock product fraction was analyzed for composition details. The naphthenes content of the additional bright stock product fraction was greater than 92 wt %. The aromatics contents of the fractions were less than 1 wt %.

Examples of Blended Fuel Products

In the following examples, various hydroprocessed deasphalted oil fractions described above were mixed with conventional refinery fractions to form marine gas oils or marine fuel oils. Table 14 shows the conventional refinery fractions that were combined with the hydroprocessed deasphalted oil fractions to form the marine gas oils or marine fuel oils.

TABLE 14

| Other Components Used in Example Blends 1-15 | | | | | |
|---|---|---|---|---|---|
| Property | Unit | Low Sulfur Gasoil (LSGO) | Marine Gasoil (MGO) | High Sulfur Gasoil (HSGO) | Heavy Gasoil (HGO) |
| Density at 15° C. | g/ml | 0.826* | 0.8545 | 0.8634 | 0.8658 |
| Distillation | | | | | |
| Temperature, 10% off | ° C. | 197.2 | 267 | 284.6 | 329.8 |
| Temperature, 50% off | ° C. | 250.0 | 322 | 318.4 | 356.6 |
| Temperature, 90% off | ° C. | 312.9 | 378 | 349.2 | 388.7 |
| Cetane Index, 2-number equation | — | 51.4 | 54.6 | 51.4 | 53.9 |
| Kinematic Viscosity at 40° C. | cSt | 2.113 | 4.2735 | 5.530 | 13.85 |
| Sulfur Content | mg/kg | 8 | 526 | 5900 | 2030 |
| Pour Point | ° C. | −19 | 6 | −11.4 | 24 |

The gas oils in Table 14 represent refinery fractions generated from processing of typical refinery feeds for forming such fractions. The low sulfur gas oil is suitable for use as an ultra low sulfur diesel fuel fraction. The marine gas oil represents a conventional marine gas oil. The high sulfur gas oil and heavy gas oil can include portions that correspond to an FCC cycle oil or coker gas oil.

Table 15 shows modeled results from blending various hydroprocessed deasphalted oil fractions with a component from Table 14 to form a marine gas oil. The model corresponds to an empirical blending model based on both laboratory scale and commercial scale data. In Table 15, the resulting blended products correspond marine gas oils having a viscosity that satisfies the standards for a DMA marine gas oil. Under ISO 8217, the upper limit for density for a DMA marine gas oil is 0.890 g/cm$^3$ and the viscosity range is 2.0 cSt to 6.0 cSt. The maximum sulfur content under ISO 8217 is 15000 wppm, but many other considerations may lead to lower requirements. For example, future regulations may reduce the upper sulfur limit to 5000 wppm in open ocean areas. Additionally, fuels used in Emission Control Areas can include no more than 1000 wppm of sulfur. For the blends in Table 15, Component 1 corresponds to the component from Table 14, while Component 2 corresponds to the hydroprocessed deasphalted oil fraction. The names for the Component 2 fractions correspond to the names used in Tables 1-13.

TABLE 15

| DMA Marine Gasoil Blends - Modeled Examples | | | | | | | |
|---|---|---|---|---|---|---|---|
| Property | Blend 1 | Blend 2 | Blend 3 | Blend 4 | Blend 5 | Blend 6 | Blend 7 |
| Component 1 | LSGO | LSGO | MGO | LSGO | MGO | HGO | HSGO |
| (Vol %) | 85 | 60 | 96 | 68 | 40 | 40 | 75 |
| Component 2 | 2nd Stage Heavy Diesel | 2nd Stage LN 1 | 1st Stage HN Feed 1 | 2nd Stage BS2 | 1st Stage Diesel 1 | 2nd Stage Diesel 2 | 2nd Stage Diesel 1 |
| (Vol %) | 15 | 40 | 4 | 32 | 60 | 60 | 25 |
| Density at 15° C. (g/ml) | 0.8302 | 0.8389 | 0.8551 | 0.8428 | 0.8579 | 0.8347 | 0.8595 |
| KV @ 40° C. (cSt) | 2.710 | 4.697 | 5.749 | 5.887 | 5.927 | 5.906 | 5.883 |

TABLE 15-continued

| DMA Marine Gasoil Blends - Modeled Examples | | | | | | | |
|---|---|---|---|---|---|---|---|
| Property | Blend 1 | Blend 2 | Blend 3 | Blend 4 | Blend 5 | Blend 6 | Blend 7 |
| Sulfur*/** (ppmw) | 7 | 5 | 505 | 5 | 215 | 842 | 4445 |

Blends 1-4 demonstrate that heavier fractions generated from hydroprocessing of deasphalted oils can potentially be blended into the DMA pool by using a blend component that compensates for the higher viscosity of the hydroprocessed deasphalted oil products. It is noted that most of the Blends shown in Table 15 have a viscosity near the upper limit for a DMA marine gas oil. Additionally, Blends 5-7 demonstrate that hydroprocessed deasphalted oil distillates can potentially be blended into the DMA pool and also demonstrate how low sulfur and/or low viscosity of $2^{nd}$ stage distillate from hydroprocessing of deasphalted oils can facilitate blending of more viscous or higher sulfur components into the DMA pool. Generally, from 0.5 wt % to 70 wt % (or possibly more) of a hydroprocessed deasphalted oil fraction can be blended with other conventional fractions to form a DMA marine gas oil.

All of the blends shown in Table 15 correspond to DMA marine gas oils with a ASTM Color of 3.0 or less, or 1.0 or less, or 0.5 or less. Additionally, all of the blends shown in Table 15 correspond to DMA marine gas oils that are clear and bright under Procedure 1 of ASTM D4176.

Table 16 shows modeled results from blending various hydroprocessed deasphalted oil fractions with a component from Table 14 to form a marine gas oil. The model corresponds to an empirical blending model based on both laboratory scale and commercial scale data. In Table 16, the resulting blended products correspond marine gas oils having a viscosity that satisfies the standards for a DMB marine gas oil. Under ISO 8217, the upper limit for density for a DMB marine gas oil is 0.900 g/cm$^3$ and the viscosity range is 2.0 cSt to 11.0 cSt. The maximum sulfur content under ISO 8217 is 20000 wppm, but many other considerations may lead to lower requirements. For example, future regulations may reduce the upper sulfur limit to 5000 wppm in open ocean areas. Additionally, fuels used in Emission Control Areas can include no more than 1000 wppm of sulfur. Component 1 corresponds to the component from Table 14, while Component 2 corresponds to the hydroprocessed deasphalted oil fraction. The names for the Component 2 fractions correspond to the names used in Tables 1-13.

Blends 8-10 demonstrate that the heavier products from hydroprocessing of a deasphalted oil can potentially be blended into the DMB pool by using a blend component that compensates for the higher viscosity of the hydroprocessed deasphalted oil products.

Additionally, Blend 11 demonstrates that hydroprocessed deasphalted oil distillate can potentially be blended into the DMB pool and also demonstrates how low sulfur and/or low viscosity of $2^{nd}$ stage distillate from hydroprocessing of a deasphalted oil can facilitate blending of more viscous, higher sulfur components into the DMB pool. Generally, from 0.5 wt % to 70 wt % (or possibly more) of a hydroprocessed deasphalted oil fraction can be blended with other conventional fractions to form a DMB marine gas oil.

All of the blends shown in Table 16 correspond to DMB marine gas oils with a ASTM Color of 3.0 or less, or 1.0 or less, or 0.5 or less. Additionally, all of the blends shown in Table 16 correspond to DMB marine gas oils that are clear and bright under Procedure 1 of ASTM D4176.

In various aspects, use of the hydroprocessed deasphalted oil products as blend components can allow for upgrading of higher sulfur distillates into the ECA pool or 5000 wppm sulfur pool. Additionally or alternately, the resulting blends can have a density at 15° C. of 0.88 g/cm$^3$ or less, or 0.86 g/cm$^3$ or less. Additionally or alternately, the resulting blends can have a kinematic viscosity at 40° C. of 2 cSt to 11 cSt, or 6 cSt to 11 cSt.

Table 17 shows modeled results from blending various hydroprocessed deasphalted oil fractions with a component from Table 14 to form a marine fuel oil. The model corresponds to an empirical blending model based on both laboratory scale and commercial scale data. In Table 17, the resulting blended products correspond marine gas oils having a viscosity that satisfies the standards for one or more types of marine fuel oil. Under ISO 8217, the upper limit for density for a marine fuel oil varies based on grade, as exemplified in Table 17. The viscosity range can also vary depending on the grade. Component 1 corresponds to the component from Table 14, while Component 2 corresponds to the hydroprocessed deasphalted oil fraction. The names for the Component 2 fractions correspond to the names used in Tables 1-13.

TABLE 16

| DMB Marine Gasoil Blends - Prophetic Examples | | | | | |
|---|---|---|---|---|---|
| Property | Blend 8 | Blend 9 | Blend 10 | Blend 11 | ISO 8217 DMB Limit |
| Component 1 | LSGO | HSGO | MGO | $2^{nd}$ Stage Diesel 1 | — |
| vol % | 45 | 60 | 75 | 55 | — |
| Component 2 | $2^{nd}$ Stage LN 1 | $2^{nd}$ Stage Heavy Diesel | $2^{nd}$ Stage BS 1 | HGO | — |
| vol % | 55 | 40 | 25 | 45 | — |
| Density at 15° C. (g/ml) | 0.8437 | 0.8597 | 0.8604 | 0.8560 | 0.900 max |
| KV @ 40° C. (cSt) | 6.784 | 8.832 | 10.974 | 9.460 | 2.000 min 11.000 max |
| Sulfur*/** (ppmw) | 4 | 3555 | 392 | 924 | 20000* |

TABLE 17

Marine Fuel Oil Blends - Prophetic Examples

| Property | Blend 12 | Blend 13 | Blend 14 | Blend 15 | ISO 8217 Limit |
|---|---|---|---|---|---|
| Component 1 | HSGO | HGO | HSGO | HSGO | — |
| vol % | 45 | 38 | 15 | 15 | — |
| Component 2 | $2^{nd}$ Stage LN 1 | $2^{nd}$ Stage HN 1 | $2^{nd}$ Stage Heavy Cracked Product | $2^{nd}$ Stage BS 2 | — |
| vol % | 55 | 62 | 85 | 85 | — |
| Density at 15° C. (g/ml) | 0.8605 | 0.8682 | 0.8650 | 0.8763 | Varies, e.g. 0.9200 max, RMA 0.9600 max, RMB 0.9750 max, RMD 0.9910 max, RME/RMG |
| KV @ 50° C. (cSt) | 9.33 | 28.80 | 37.30 | 110.83 | Varies, e.g. 10 max, RMA 10 30 max, RMB 30 80 max, RMD 80 180 max, RME/RMG 180 380 max, RMG 380 |
| Sulfur*/** (ppmw) | 2664 | 769 | 883 | 872 | Statutory Requirements |
| CCAI | 779 | 764 | 756 | 751 | Varies, e.g. 850 max, RMA 860 max, RMD/RME/RMD/RMB 870x, RMG |

It is noted that select hydroprocessed deasphalted oil heavy products may be able to meet the fuel oil limits above as-is. For example, $2^{nd}$ Stage BS product from hydroprocessing of deasphalted oil can meet the above limits for RMG 380. A $2^{nd}$ stage HN product and/or heavy cracked BS product from hydroprocessing of deasphalted oil can meet the above limits for RMD 80. A $2^{nd}$ Stage LN product and/or light cracked BS product from hydroprocessing a deasphalted oil can meet the above limits for RMB 30. However, this is not an efficient use of such products from a commercial standpoint since there would be significant sulfur giveaway. The above blends demonstrate how higher sulfur gas oils may be blended with hydroprocessed deasphalted oil products to make a final blend with reduced sulfur giveaway.

In various aspects, use of the hydroprocessed deasphalted oil products as blend components can allow for upgrading of higher sulfur distillates into the ECA pool or 5000 wppm sulfur pool. Additionally or alternately, the resulting blends can have a density at 15° C. of 0.90 g/cm$^3$ or less, or 0.88 g/cm$^3$ or less. Additionally or alternately, the resulting blends can have a kinematic viscosity at 50° C. of 180 cSt or less, or 80 cSt or less, or 30 cSt or less, or 10 cSt or less. Additionally or alternately, the resulting blends can have a CCAI of 800 or less, or 780 or less.

Generally, from 0.5 wt % to 80 wt % (or possibly more) of a hydroprocessed deasphalted oil fraction can be blended with other conventional fractions to form a marine fuel oil. All of the blends shown in Table 17 correspond to marine fuel oils with a ASTM Color of 3.0 or less, or 1.0 or less, or 0.5 or less. Additionally, all of the blends shown in Table 17 correspond to marine fuel oils that are clear and bright under Procedure 1 of ASTM D4176.

ADDITIONAL EMBODIMENTS

Embodiment 1

A marine fuel oil composition comprising 5 wt % or more of a hydroprocessed deasphalted oil fraction (or 5 wt % to 80 wt %), the deasphalted oil fraction comprising a T10 distillation point of 200° C. or more, the marine fuel oil composition comprising an ASTM Color according to ASTM D1500 of 3.0 or less, a density at 15° C. of 0.84 g/cm$^3$ to 0.99 g/cm$^3$, a kinematic viscosity at 50° C. of 380 cSt or less (or 180 cSt or less), a sulfur content of 5000 wppm or less, and a CCAI of 850 or less.

Embodiment 2

A method for forming a marine fuel oil composition, comprising blending 5 wt % or more of a hydroprocessed deasphalted oil product with one or more additional blend components, the deasphalted oil product comprising a T10 distillation point of 200° C. or more, a viscosity index of 80 or more, a kinematic viscosity at 100° C. of 3.5 cSt or more, a saturates content of 95 wt % or more, a naphthenes content of 50 wt % or more, and a sulfur content of 300 wppm or less, the marine fuel oil composition comprising an ASTM Color according to ASTM D1500 of 3.0 or less, a density at 15° C. of 0.84 g/cm$^3$ to 0.99 g/cm$^3$, a kinematic viscosity at 50° C. of 380 cSt or less, a sulfur content of 5000 wppm or less, and a CCAI of 850 or less.

Embodiment 3

The marine fuel oil composition or method for forming a marine fuel oil composition of any of the above embodiments, wherein the composition comprises an ASTM Color of 1.0 or less, or 0.5 or less; or wherein the composition is clear and bright according to Procedure 1 of ASTM D4176; or a combination thereof.

Embodiment 4

The marine fuel oil composition or method for forming a marine fuel oil composition of any of the above embodiments, wherein the marine fuel oil composition comprises 10 wt % or more of the hydroprocessed deasphalted oil, or 25 wt % or more, or 40 wt % or more, or 50 wt % or more, or 60 wt % or more.

Embodiment 5

The marine fuel oil composition or method for forming a marine fuel oil composition of any of the above embodiments, wherein the marine fuel oil composition comprises a CCAI of 800 or less, or 780 or less, or 760 or less; or wherein the marine fuel oil composition comprises a sulfur content of 1000 wppm or less; or a combination thereof.

Embodiment 6

The marine fuel oil composition or method for forming a marine fuel oil composition of any of the above embodiments, wherein the marine fuel oil composition comprises a) a density at 15° C. of 0.85 g/cm$^3$ to 0.92 g/cm$^3$ and a kinematic viscosity at 50° C. of 10 cSt or less; b) a density at 15° C. of 0.85 g/cm$^3$ to 0.96 g/cm$^3$ and a kinematic viscosity at 50° C. of 30 cSt or less; or c) a density at 15° C. of 0.85 g/cm$^3$ to 0.98 g/cm$^3$ and a kinematic viscosity at 50° C. of 80 cSt or less.

Embodiment 7

The marine fuel oil composition or method for forming a marine fuel oil composition of any of the above embodiments, wherein the marine fuel oil composition comprises a density at 15° C. of 0.85 g/cm$^3$ to 0.89 g/cm$^3$.

Embodiment 8

A marine gas oil composition comprising 0.5 wt % to 80 wt % of a hydroprocessed deasphalted oil product, the deasphalted oil product comprising a T10 distillation point of 200° C. or more, the marine gas oil composition comprising an ASTM Color according to ASTM D1500 of 3.0 or less, a density at 15° C. of 0.81 g/cm$^3$ to 0.90 g/cm$^3$, a kinematic viscosity at 40° C. of 2.0 cSt to 11 cSt or less, and a sulfur content of 5000 wppm or less (or 1000 wppm or less, or 500 wppm or less).

Embodiment 9

A method for forming a marine gas oil composition, comprising blending 0.5 wt % to 80 wt % of a hydroprocessed deasphalted oil product with one or more additional blend components, the deasphalted oil product comprising a T10 distillation point of 200° C. or more, the marine gas oil composition comprising an ASTM Color according to ASTM D1500 of 3.0 or less, a density at 15° C. of 0.81 g/cm$^3$ to 0.90 g/cm$^3$, a kinematic viscosity at 40° C. of 2.0 cSt to 11 cSt or less, and a sulfur content of 5000 wppm or less (or 1000 wppm or less, or 500 wppm or less).

Embodiment 10

The marine gas oil composition of Embodiments 8 or 9, wherein the marine gas oil composition comprises a density at 15° C. of 0.83 g/cm$^3$ to 0.90 g/cm$^3$ and 20 wt % to 80 wt % of the hydroprocessed deasphalted oil (or 35 wt % to 80 wt %, or 45 wt % to 80 wt %); or wherein the marine gas oil composition comprises a kinematic viscosity at 40° C. of 6.0 cSt or more, or 8.0 cSt or more; or a combination thereof.

Embodiment 11

The marine gas oil composition of any of Embodiments 8 to 10, wherein the marine gas oil composition comprises 0.5 wt % to 70 wt % of the hydroprocessed deasphalted oil (or 15 wt % to 70 wt %, or 25 wt % to 70 wt %, or 35 wt % to 70 wt %), a density at 15° C. of 0.84 g/cm$^3$ to 0.90 g/cm$^3$, and a kinematic viscosity at 40° C. of 2.0 cSt to 6.0 cSt.

Embodiment 12

The marine gas oil composition of any of Embodiments 8 to 11, wherein the hydroprocessed deasphalted oil product comprises a kinematic viscosity at 40° C. of 3.5 cSt or more (or 3.5 cSt to 100 cSt) a saturates content of 98 wt % or more, a naphthenes content of 40 wt % or more, and a sulfur content of 300 wppm or less, the hydroprocessed deasphalted oil optionally comprising a cetane index of 50 or more, or 55 or more and/or a T90 distillation point of 600° C. or less, or 400° C. or less, or 370° C. or less.

Embodiment 13

The marine fuel oil composition, marine gas oil composition, or method of making a marine fuel oil composition or marine gas oil composition of any of Embodiments 1 or 3-12, wherein the hydroprocessed deasphalted oil product comprises a viscosity index of 80 or more (or 80 to 130, or 80 to 120, or 100 to 130), a kinematic viscosity at 100° C. of 3.5 cSt or more (or 3.5 cSt to 50 cSt), a saturates content of 95 wt % or more (or 98 wt % or more), a naphthenes content of 50 wt % or more, and a sulfur content of 300 wppm or less.

Embodiment 14

The marine fuel oil composition, marine gas oil composition, or method of making a marine fuel oil composition or marine gas oil composition of any of the above claims, wherein the hydroprocessed deasphalted oil comprises a naphthenes content of 70 wt % or more, or 80 wt % or more; or wherein the hydroprocessed deasphalted oil comprises a sulfur content of 100 wppm or less, or 50 wppm or less; or wherein the hydroprocessed deasphalted oil comprises a kinematic viscosity at 100° C. of 8.0 cSt or more, or 15 cSt or more, or 30 cSt or more; or a combination thereof.

Embodiment 15

The marine fuel oil composition, marine gas oil composition, or method of making a marine fuel oil composition or marine gas oil composition of any of the above claims, wherein the marine fuel oil composition or marine gas oil composition comprises an ASTM Color of 1.0 or less, or 0.5 or less; or wherein the marine fuel oil composition or marine gas oil composition is clear and bright according to Procedure 1 of ASTM D4176; or wherein the marine fuel oil composition or marine gas oil composition further comprises an additive, the additive optionally comprising an additive for modifying a pour point, a cold filter plugging point, a lubricity, a conductivity, or a combination thereof.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A marine fuel oil composition comprising 5 wt % or more of a hydroprocessed deasphalted oil fraction, the deasphalted oil fraction comprising a T10 distillation point of 200° C. or more, the marine fuel oil composition comprising an ASTM Color according to ASTM D1500 of 3.0 or less, a density at 15° C. of 0.84 g/cm$^3$ to 0.99 g/cm$^3$, a kinematic viscosity at 50° C. of 380 cSt or less, a sulfur content of 5000 wppm or less, and a CCAI of 850 or less.

2. The marine fuel oil composition of claim 1, wherein the hydroprocessed deasphalted oil product comprises a viscosity index of 80 or more, a kinematic viscosity at 100° C. of 3.5 cSt or more, a saturates content of 95 wt % or more, a naphthenes content of 50 wt % or more, and a sulfur content of 300 wppm or less.

3. The marine fuel oil composition of claim 2, wherein the hydroprocessed deasphalted oil comprises a naphthenes content of 70 wt % or more; or wherein the hydroprocessed deasphalted oil comprises a sulfur content of 100 wppm or less; or a combination thereof.

4. The marine fuel oil composition of claim 2, wherein the hydroprocessed deasphalted oil comprises a kinematic viscosity at 100° C. of 8.0 cSt or more.

5. The marine fuel oil composition of claim 1, wherein the marine fuel oil composition comprises an ASTM Color of 1.0 or less; or wherein the marine fuel oil composition is clear and bright according to Procedure 1 of ASTM D4176; or a combination thereof.

6. The marine fuel oil composition of claim 1, wherein the marine fuel oil composition comprises 25 wt % or more of the hydroprocessed deasphalted oil.

7. The marine fuel oil composition of claim 1, wherein the marine fuel oil composition comprises a CCAI of 800 or less; or wherein the marine fuel oil composition comprises a sulfur content of 1000 wppm or less; or a combination thereof.

8. The marine fuel oil composition of claim 1, wherein the marine fuel oil composition comprises a) a density at 15° C. of 0.85 g/cm$^3$ to 0.92 g/cm$^3$ and a kinematic viscosity at 50° C. of 10 cSt or less;

b) a density at 15° C. of 0.85 g/cm$^3$ to 0.96 g/cm$^3$ and a kinematic viscosity at 50° C. of 30 cSt or less; or c) a density at 15° C. of 0.85 g/cm$^3$ to 0.98 g/cm$^3$ and a kinematic viscosity at 50° C. of 80 cSt or less.

9. The marine fuel oil composition of claim 1, wherein the marine fuel oil composition further comprises an additive.

10. The marine fuel oil composition of claim 1, wherein the additive comprises an additive for modifying a pour point, a cold filter plugging point, a lubricity, a conductivity, or a combination thereof.

11. A marine gas oil composition comprising 0.5 wt % to 80 wt % of a hydroprocessed deasphalted oil product, the deasphalted oil product comprising a T10 distillation point of 200° C. or more, the marine gas oil composition comprising an ASTM Color according to ASTM D1500 of 3.0 or less, a density at 15° C. of 0.81 g/cm$^3$ to 0.90 g/cm$^3$, a kinematic viscosity at 40° C. of 2.0 cSt to 11 cSt or less, and a sulfur content of 5000 wppm or less.

12. The marine gas oil composition of claim 11, wherein the marine gas oil composition comprises a density at 15° C. of 0.83 g/cm$^3$ to 0.90 g/cm$^3$ and 20 wt % to 80 wt % of the hydroprocessed deasphalted oil.

13. The marine gas oil composition of claim 11, wherein the marine gas oil composition comprises a kinematic viscosity at 40° C. of 6.0 cSt or more.

14. The marine gas oil composition of claim 11, wherein the marine gas oil composition comprises 0.5 wt % to 70 wt % of the hydroprocessed deasphalted oil, a density at 15° C. of 0.84 g/cm$^3$ to 0.90 g/cm$^3$, and a kinematic viscosity at 40° C. of 2.0 cSt to 6.0 cSt.

15. The marine gas oil composition of claim 11, wherein the marine gas oil composition comprises an ASTM Color of 1.0 or less; or wherein the marine gas oil composition is clear and bright according to Procedure 1 of ASTM D4176; or a combination thereof.

16. The marine gas oil composition of claim 11, wherein the marine gas oil composition comprises a sulfur content of 1000 wppm or less.

17. The marine gas oil composition of claim 11, wherein the hydroprocessed deasphalted oil product comprises a viscosity index of 80 or more, a kinematic viscosity at 100° C. of 3.5 cSt or more, a saturates content of 95 wt % or more, a naphthenes content of 50 wt % or more, and a sulfur content of 300 wppm or less.

18. The marine gas oil composition of claim 17, wherein the hydroprocessed deasphalted oil comprises a naphthenes content of 70 wt % or more; or wherein the hydroprocessed deasphalted oil comprises a sulfur content of 100 wppm or less; or wherein the hydroprocessed deasphalted oil comprises a kinematic viscosity at 100° C. of 8.0 cSt or more; or a combination thereof.

19. The marine gas oil composition of claim 11, wherein the hydroprocessed deasphalted oil product comprises a kinematic viscosity at 40° C. of 3.5 cSt or more, a saturates content of 98 wt % or more, a naphthenes content of 40 wt % or more, and a sulfur content of 300 wppm or less.

20. The marine gas oil composition of claim 19, wherein the hydroprocessed deasphalted oil comprises a cetane index of 50 or more; or wherein the hydroprocessed deasphalted oil comprises a T90 distillation point of 400° C. or less, or 370° C. or less; or a combination thereof.

21. The marine gas oil composition of claim 11, wherein the hydroprocessed deasphalted oil comprises a kinematic viscosity at 40° C. of 3.5 cSt to 100 cSt; or wherein the hydroprocessed deasphalted oil comprises a T10 distillation point of 200° C. or more and a T90 distillation point of 600° C. or less; or a combination thereof.

22. The marine gas oil composition of claim 11, wherein the marine gas oil composition further comprises an additive, the additive optionally comprising an additive for modifying a pour point, a cold filter plugging point, a lubricity, a conductivity, or a combination thereof.

23. A method for forming a marine fuel oil composition, comprising blending 5 wt % or more of a hydroprocessed deasphalted oil product with one or more additional blend components, the deasphalted oil product comprising a T10 distillation point of 200° C. or more, a viscosity index of 80 or more, a kinematic viscosity at 100° C. of 3.5 cSt or more, a saturates content of 95 wt % or more, a naphthenes content of 50 wt % or more, and a sulfur content of 300 wppm or less, the marine fuel oil composition comprising an ASTM Color according to ASTM D1500 of 3.0 or less, a density at 15° C. of 0.84 g/cm$^3$ to 0.99 g/cm$^3$, a kinematic viscosity at 50° C. of 380 cSt or less, a sulfur content of 5000 wppm or less, and a CCAI of 850 or less.

24. A method for forming a marine gas oil composition, comprising blending 0.5 wt % to 80 wt % of a hydroprocessed deasphalted oil product with one or more additional blend components, the deasphalted oil product comprising a T10 distillation point of 200° C. or more, the marine gas oil composition comprising an ASTM Color according to ASTM D1500 of 3.0 or less, a density at 15° C. of 0.81 g/cm$^3$ to 0.90 g/cm$^3$, a kinematic viscosity at 40° C. of 2.0 cSt to 11 cSt or less, and a sulfur content of 5000 wppm or less.

25. The method for forming a marine gas oil composition of claim 24, wherein the marine gas oil composition comprises 20 wt % to 80 wt % of the hydroprocessed deasphalted oil and a density at 15° C. of 0.84 g/cm$^3$ to 0.90 g/cm$^3$.

* * * * *